US010178909B2

(12) United States Patent
Hardy et al.

(10) Patent No.: US 10,178,909 B2
(45) Date of Patent: Jan. 15, 2019

(54) ANTI-SPLAY DEVICE FOR MERCHANDISE DISPLAY SYSTEM

(71) Applicant: RTC Industries, Inc., Rolling Meadows, IL (US)

(72) Inventors: Stephen N. Hardy, Wadsworth, OH (US); Tony Dipaolo, Naperville, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 15/406,287

(22) Filed: Jan. 13, 2017

(65) Prior Publication Data

US 2017/0196355 A1 Jul. 13, 2017

Related U.S. Application Data

(60) Provisional application No. 62/278,312, filed on Jan. 13, 2016.

(51) Int. Cl.
*A47F 5/00* (2006.01)
*A47F 1/12* (2006.01)
(Continued)

(52) U.S. Cl.
CPC ..... *A47B 57/588* (2013.01); *A47F 1/126* (2013.01); *A47F 5/005* (2013.01); *A47F 7/0007* (2013.01); *A47F 7/28* (2013.01)

(58) Field of Classification Search
CPC .... A47F 1/04; A47F 1/12; A47F 1/125; A47F 1/126; A47F 5/005; A47F 5/0093; A47F 5/0025
See application file for complete search history.

(56) References Cited

U.S. PATENT DOCUMENTS 153,227 A 4/1874 Walkee
154,940 A 9/1874 Adams
(Continued)

FOREIGN PATENT DOCUMENTS

AU 2012301697 A1 4/2014
AU 2012301707 A1 4/2014
(Continued)

OTHER PUBLICATIONS

Mar. 29, 2017—(PCT) International Search Report and Written Opinion—App PCT/US2017/013494.
(Continued)

*Primary Examiner* — Kimberley S Wright
(74) *Attorney, Agent, or Firm* — Banner & Witcoff, Ltd.

(57) ABSTRACT

A merchandising display system can include one or more of a front rail configured to mount to a shelf, a first divider assembly, a second divider assembly, and a central track or floor, and a pusher assembly. In one example aspect, the example merchandising display system can be configured to prevent splaying of the divider assemblies when a row of product is loaded toward the rear of the shelf or when displaying the product in rows on the shelf. In one example, the central track in conjunction with the weight of the product can be configured to maintain even spacing between the first divider assembly and the second divider assembly, such that the first divider assembly and the second divider assembly are maintained in position on the shelf thereby maintaining the product organized in their respective rows on the shelf.

19 Claims, 14 Drawing Sheets

(51) Int. Cl.

| | |
|---|---|
| ***A47F 1/04*** | (2006.01) |
| ***A47B 57/58*** | (2006.01) |
| ***A47F 7/00*** | (2006.01) |
| ***A47F 7/28*** | (2006.01) |

(56) References Cited

U.S. PATENT DOCUMENTS

| | | | |
|---|---|---|---|
| 355,511 | A | 1/1887 | Danner |
| 431,373 | A | 7/1890 | Mendenhall |
| 436,704 | A | 9/1890 | Green |
| 452,673 | A | 5/1891 | Hunter |
| 551,642 | A | 12/1895 | Kleine |
| 607,890 | A | 7/1898 | Smith |
| 607,891 | A | 7/1898 | Smith |
| 632,231 | A | 9/1899 | Blades |
| 808,067 | A | 12/1905 | Briggs |
| 847,863 | A | 3/1907 | Watts |
| 927,988 | A | 7/1909 | Massey |
| 1,030,317 | A | 6/1912 | Middaugh |
| 1,156,140 | A | 10/1915 | Hair |
| 1,271,508 | A | 7/1918 | Hall |
| 1,282,532 | A | 10/1918 | Bochenek |
| 1,674,582 | A | 6/1928 | Wheeler |
| 1,682,580 | A | 8/1928 | Pratt |
| 1,703,987 | A | 3/1929 | Butler |
| 1,712,080 | A | 5/1929 | Kelly |
| 1,714,266 | A | 5/1929 | Johnson |
| 1,734,031 | A | 11/1929 | Carlston |
| 1,786,392 | A | 12/1930 | Kemp |
| 1,821,350 | A | 9/1931 | Levy |
| 1,849,024 | A | 3/1932 | McKee |
| 1,910,516 | A | 5/1933 | Basenberg |
| 1,964,597 | A | 6/1934 | Rapellin |
| 1,971,749 | A | 8/1934 | Hamilton |
| 1,991,102 | A | 2/1935 | Kemaghan |
| 2,013,284 | A | 9/1935 | Michaud |
| 2,057,627 | A | 10/1936 | Ferris |
| 2,076,941 | A | 4/1937 | Farr |
| 2,079,754 | A | 5/1937 | Waxgiser |
| 2,085,479 | A | 6/1937 | Shaffer et al. |
| 2,110,299 | A | 3/1938 | Hinkle |
| 2,111,496 | A | 3/1938 | Scriba |
| 2,129,122 | A | 9/1938 | Follett |
| 2,185,605 | A | 1/1940 | Murphy |
| 2,218,444 | A | 10/1940 | Vineyard |
| 2,284,849 | A | 6/1942 | Schreyer |
| 2,308,851 | A | 1/1943 | Anderson |
| 2,499,088 | A | 2/1950 | Brill |
| 2,516,122 | A | 7/1950 | Hughes |
| 2,520,738 | A | 8/1950 | Segal |
| 2,522,896 | A | 9/1950 | Rifkin |
| 2,538,165 | A | 1/1951 | Randtke |
| 2,538,908 | A | 1/1951 | McKeehan |
| 2,555,102 | A | 5/1951 | Anderson |
| 2,563,570 | A | 8/1951 | Williams |
| 2,634,855 | A | 4/1953 | Mandel |
| 2,652,154 | A | 9/1953 | Stevens |
| 2,670,853 | A | 3/1954 | Schneider |
| 2,678,045 | A | 5/1954 | Erhard |
| 2,730,825 | A | 1/1956 | Wilds |
| 2,732,952 | A | 1/1956 | Skelton |
| 2,738,881 | A | 3/1956 | Michel |
| 2,750,049 | A | 6/1956 | Hunter |
| 2,767,042 | A | 10/1956 | Kesling |
| 2,775,365 | A | 12/1956 | Mestman |
| 2,784,871 | A | 3/1957 | Gabrielsen |
| 2,828,178 | A | 3/1958 | Dahlgren |
| 2,893,596 | A | 7/1959 | Gabrielsen |
| 2,918,295 | A | 12/1959 | Milner |
| 2,934,212 | A | 4/1960 | Jacobson |
| 2,948,403 | A | 8/1960 | Vallez |
| 2,964,154 | A | 12/1960 | Erickson |
| 3,083,067 | A | 3/1963 | Vos et al. |
| 3,103,396 | A | 9/1963 | Portnoy |
| 3,110,402 | A | 11/1963 | Mogulescu |
| 3,121,494 | A | 2/1964 | Berk |
| 3,122,236 | A | 2/1964 | Michiel |
| 3,124,254 | A | 3/1964 | Davidson |
| 3,151,576 | A | 10/1964 | Patterson |
| 3,161,295 | A | 12/1964 | Chesley |
| 3,166,195 | A | 1/1965 | Taber |
| 3,285,429 | A | 11/1966 | Propst |
| 3,300,166 | A | 1/1967 | Wojciechowski |
| 3,308,961 | A | 3/1967 | Chesley |
| 3,308,964 | A | 3/1967 | Pistone |
| 3,331,337 | A | 7/1967 | MacKay |
| 3,348,732 | A | 10/1967 | Shwarz |
| 3,405,716 | A | 10/1968 | Cafiero |
| 3,452,899 | A | 7/1969 | Libberton |
| 3,497,081 | A | 2/1970 | Field |
| 3,501,016 | A | 3/1970 | Kenneth |
| 3,501,019 | A | 3/1970 | Armstron |
| 3,501,020 | A | 3/1970 | Krikorian |
| 3,512,652 | A | 5/1970 | Armstrong |
| D219,058 | S | 10/1970 | Kaczur |
| 3,550,979 | A | 12/1970 | Protzmann |
| 3,598,246 | A | 8/1971 | Galli |
| 3,625,371 | A | 12/1971 | Dill |
| 3,652,154 | A | 3/1972 | Gebel |
| 3,667,826 | A | 6/1972 | Wood |
| 3,698,568 | A | 10/1972 | Armstrong |
| 3,709,371 | A | 1/1973 | Luck |
| 3,751,129 | A | 8/1973 | Wright et al. |
| 3,767,083 | A | 10/1973 | Webb |
| 3,776,388 | A | 12/1973 | Mattheis |
| 3,780,876 | A | 12/1973 | Elkins |
| 3,814,490 | A | 6/1974 | Dean et al. |
| 3,815,519 | A | 6/1974 | Meyer |
| 3,830,169 | A | 8/1974 | Madey |
| 3,836,008 | A | 9/1974 | Mraz |
| 3,848,745 | A | 11/1974 | Smith |
| 3,868,021 | A | 2/1975 | Heinrich |
| 3,870,156 | A | 3/1975 | O'Neill |
| 3,893,739 | A | 7/1975 | Bernard |
| 3,923,159 | A | 12/1975 | Taylor et al. |
| 3,949,880 | A | 4/1976 | Fortunato |
| 3,960,273 | A | 6/1976 | Weston |
| 4,007,841 | A | 2/1977 | Seipel |
| 4,015,886 | A | 4/1977 | Wickenberg |
| 4,042,096 | A | 8/1977 | Smith |
| 4,106,668 | A | 8/1978 | Gebhardt et al. |
| 4,205,763 | A | 6/1980 | Merl |
| 4,266,355 | A | 5/1981 | Moss |
| 4,269,326 | A | 5/1981 | Delbrouck |
| 4,300,693 | A | 11/1981 | Spamer |
| 4,303,162 | A | 12/1981 | Suttles |
| 4,331,243 | A | 5/1982 | Doll |
| 4,351,439 | A | 9/1982 | Taylor |
| 4,378,872 | A | 4/1983 | Brown |
| 4,397,606 | A | 8/1983 | Bruton |
| 4,416,380 | A | 11/1983 | Flum |
| 4,437,572 | A | 3/1984 | Hoffman |
| 4,448,653 | A | 5/1984 | Wegmann |
| 4,454,948 | A | 6/1984 | Spamer |
| 4,454,949 | A | 6/1984 | Flum |
| 4,460,096 | A | 7/1984 | Ricci |
| D275,058 | S | 8/1984 | Flum |
| 4,463,854 | A | 8/1984 | MacKenzie |
| 4,467,927 | A | 8/1984 | Nathan |
| 4,470,943 | A | 9/1984 | Preis |
| 4,476,985 | A | 10/1984 | Norberg et al. |
| 4,478,337 | A | 10/1984 | Flum |
| 4,482,066 | A | 11/1984 | Dykstra |
| 4,488,653 | A | 12/1984 | Belokin |
| 4,500,147 | A | 2/1985 | Reister |
| 4,504,100 | A | 3/1985 | Chaumard |
| 4,550,838 | A | 11/1985 | Nathan et al. |
| 4,588,093 | A | 5/1986 | Field |
| 4,589,349 | A | 5/1986 | Gebhardt et al. |
| 4,590,696 | A | 5/1986 | Squitieri |
| 4,593,823 | A | 6/1986 | Fershko et al. |
| 4,602,560 | A | 7/1986 | Jacky |
| 4,606,280 | A | 8/1986 | Poulton et al. |
| 4,610,491 | A | 9/1986 | Freeman |

(56) References Cited

U.S. PATENT DOCUMENTS 4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,705,175 A 11/1987 Howard et al.
4,706,821 A 11/1987 Kohls et al.
4,712,694 A 12/1987 Breslow
4,724,968 A 2/1988 Wombacher
4,729,481 A 3/1988 Hawkinson et al.
4,730,741 A 3/1988 Jackle, III et al.
4,742,936 A 5/1988 Rein
4,744,489 A 5/1988 Binder et al.
4,762,235 A 8/1988 Howard et al.
4,768,661 A 9/1988 Pfeifer
4,771,898 A 9/1988 Howard et al.
4,775,058 A 10/1988 Yatsko
4,776,472 A 10/1988 Rosen
4,790,037 A 12/1988 Phillips
4,801,025 A 1/1989 Flum et al.
4,809,855 A 3/1989 Bustos
4,821,894 A 4/1989 Dechirot
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,887,724 A 12/1989 Pielechowski et al.
4,887,737 A 12/1989 Adenau
4,896,779 A 1/1990 Jureckson
4,899,668 A 2/1990 Valiulis
4,899,893 A 2/1990 Robertson
4,901,853 A 2/1990 Maryatt
4,901,869 A 2/1990 Hawkinson et al.
4,901,872 A 2/1990 Lang
4,907,707 A 3/1990 Crum
4,923,070 A 5/1990 Jackle et al.
4,934,645 A 6/1990 Breslow
4,944,924 A 7/1990 Mawhirt et al.
4,958,739 A 9/1990 Spamer
4,981,224 A 1/1991 Rushing
4,997,094 A 3/1991 Spamer et al.
5,012,936 A 5/1991 Crum
5,025,936 A 6/1991 Lamoureaux
5,027,957 A 7/1991 Skalski
5,054,629 A 10/1991 Breen
5,082,125 A 1/1992 Ninni
5,088,607 A 2/1992 Risafi et al.
5,110,192 A 5/1992 Lauterbach
5,111,942 A 5/1992 Bernardin
5,123,546 A 6/1992 Crum
5,131,563 A 7/1992 Yablans
5,148,927 A 9/1992 Gebka
5,159,753 A 11/1992 Torrence
5,161,702 A 11/1992 Skalski
5,161,704 A 11/1992 Valiulis
5,178,258 A 1/1993 Smalley et al.
5,183,166 A 2/1993 Belokin, Jr. et al.
5,190,186 A 3/1993 Yablans et al.
5,197,610 A 3/1993 Bustos
5,197,631 A 3/1993 Mishima
5,203,463 A 4/1993 Gold
5,215,199 A 6/1993 Bejarano
5,240,126 A 8/1993 Foster et al.
5,255,802 A 10/1993 Krinke et al.
5,265,738 A 11/1993 Yablans et al.
5,295,596 A 3/1994 Squitieri
5,316,154 A 5/1994 Hajec, Jr.
5,322,668 A 6/1994 Tomasso
5,341,945 A 8/1994 Gibson
5,351,839 A 10/1994 Beeler et al.
5,366,099 A 11/1994 Schmid
5,381,908 A 1/1995 Hepp
5,390,802 A 2/1995 Pappagallo et al.
5,397,006 A 3/1995 Terrell
5,397,016 A 3/1995 Torrence et al.
5,405,193 A 4/1995 Herrenbruck
5,408,775 A 4/1995 Abramson et al.
5,411,146 A 5/1995 Jarecki et al.
5,413,229 A 5/1995 Zuberbuhler et al.
5,415,297 A 5/1995 Klein et al.
5,419,066 A 5/1995 Harnois et al.
5,439,122 A 8/1995 Ramsay
5,450,969 A 9/1995 Johnson et al.
5,458,248 A 10/1995 Alain
5,464,105 A 11/1995 Mandeltort
5,469,975 A 11/1995 Fajnsztajn
5,469,976 A 11/1995 Burchell
5,505,315 A 4/1996 Carroll
5,542,552 A 8/1996 Yablans et al.
5,562,217 A 10/1996 Salveson et al.
5,577,337 A 11/1996 Lin
5,597,150 A 1/1997 Stein et al.
5,613,621 A 3/1997 Gervasi et al.
D378,888 S 4/1997 Bertilsson
5,615,780 A 4/1997 Nimetz et al.
5,634,564 A 6/1997 Spamer et al.
5,638,963 A 6/1997 Finnelly et al.
5,641,082 A 6/1997 Grainger
5,645,176 A 7/1997 Jay
5,655,670 A 8/1997 Stuart
5,657,702 A 8/1997 Ribeyrolles
5,665,304 A 9/1997 Heinen et al.
5,671,851 A 9/1997 Johnson et al.
5,673,801 A 10/1997 Markson
D386,363 S 11/1997 Dardashti
5,682,824 A 11/1997 Visk
5,685,664 A 11/1997 Parham et al.
5,690,038 A 11/1997 Merit et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,765,390 A 6/1998 Johnson et al.
5,788,090 A 8/1998 Kajiwara
5,803,276 A 9/1998 Vogler
5,806,690 A 9/1998 Johnson et al.
5,826,731 A 10/1998 Dardashti
5,839,588 A 11/1998 Hawkinson
5,848,709 A 12/1998 Gelphman et al.
5,855,283 A 1/1999 Johnson
D405,632 S 2/1999 Parham
5,865,324 A 2/1999 Jay et al.
5,868,367 A 2/1999 Smith
5,873,473 A 2/1999 Pater
5,873,489 A 2/1999 Ide et al.
5,878,895 A 3/1999 Springs
5,881,910 A 3/1999 Rein
5,887,732 A 3/1999 Zimmer et al.
5,904,256 A 5/1999 Jay
5,906,283 A 5/1999 Kump et al.
5,944,201 A 8/1999 Babboni et al.
5,951,228 A 9/1999 Pfeiffer et al.
5,970,887 A 10/1999 Hardy
5,971,173 A 10/1999 Valiulis et al.
5,971,204 A 10/1999 Apps
5,975,318 A 11/1999 Jay
5,992,652 A 11/1999 Springs
5,992,653 A 11/1999 Anderson et al.
6,003,690 A 12/1999 Allen et al.
6,006,678 A 12/1999 Merit et al.
6,007,248 A 12/1999 Fulterer
6,015,051 A 1/2000 Battaglia
6,021,908 A 2/2000 Mathews
6,026,984 A 2/2000 Perrin
6,035,569 A 3/2000 Nagel et al.
6,041,720 A 3/2000 Hardy

(56) References Cited

U.S. PATENT DOCUMENTS 6,044,982 A 4/2000 Stuart
6,047,647 A 4/2000 Laraia, Jr.
6,068,142 A 5/2000 Primiano
6,076,670 A 6/2000 Yeranossian
6,082,556 A 7/2000 Primiano et al.
6,082,557 A 7/2000 Leahy
6,082,558 A 7/2000 Battaglia
6,089,385 A 7/2000 Nozawa
6,102,185 A 8/2000 Neuwirth et al.
6,112,938 A 9/2000 Apps
6,129,218 A 10/2000 Henry et al.
6,132,158 A 10/2000 Pfeiffer et al.
6,142,316 A 11/2000 Harbour et al.
6,142,317 A 11/2000 Merl
6,155,438 A 12/2000 Close
6,158,598 A 12/2000 Josefsson
6,164,462 A 12/2000 Mumford
6,164,491 A 12/2000 Bustos et al.
6,173,845 B1 1/2001 Higgins et al.
6,186,725 B1 2/2001 Konstant
6,189,734 B1 2/2001 Apps et al.
6,209,731 B1 4/2001 Spamer et al.
6,209,733 B1 4/2001 Higgins et al.
6,226,910 B1 5/2001 Ireland
6,227,385 B1 5/2001 Nickerson
6,227,386 B1 5/2001 Close
6,234,325 B1 5/2001 Higgins et al.
6,234,326 B1 5/2001 Higgins et al.
6,234,328 B1 5/2001 Mason
6,237,784 B1 5/2001 Primiano
D445,615 S 7/2001 Burke
6,253,954 B1 7/2001 Yasaka
6,299,004 B1 10/2001 Thalenfeld et al.
6,305,559 B1 10/2001 Hardy
6,308,839 B1 10/2001 Steinberg et al.
6,309,034 B1 10/2001 Credle, Jr. et al.
6,311,852 B1 11/2001 Ireland
6,325,221 B2 12/2001 Parham
6,325,222 B1 12/2001 Avery et al.
6,330,758 B1 12/2001 Feibelman
6,357,606 B1 * 3/2002 Henry ..... A47F 1/126
211/184
6,357,985 B1 3/2002 Anzani et al.
6,375,015 B1 4/2002 Wingate
6,378,727 B1 4/2002 Dupuis et al.
6,382,431 B1 5/2002 Burke
6,390,310 B1 5/2002 Insalaco
6,398,044 B1 6/2002 Robertson
6,401,942 B1 6/2002 Eckert
6,405,880 B1 6/2002 Webb
6,409,026 B2 6/2002 Watanabe
6,409,027 B1 6/2002 Chang et al.
6,409,028 B2 6/2002 Nickerson
6,419,100 B1 7/2002 Menz et al.
6,428,123 B1 8/2002 Lucht et al.
6,431,808 B1 8/2002 Lowrey et al.
6,435,359 B1 8/2002 Priminano
6,439,402 B2 8/2002 Robertson
6,454,107 B1 9/2002 Belanger et al.
6,464,089 B1 10/2002 Rankin, VI
6,471,053 B1 10/2002 Feibelman
6,471,081 B1 10/2002 Weiler
6,484,891 B2 11/2002 Burke
6,490,983 B1 12/2002 Nicholson et al.
6,497,326 B1 12/2002 Osawa
6,505,747 B1 1/2003 Robertson
6,523,664 B2 2/2003 Shaw et al.
6,523,702 B1 2/2003 Primiano et al.
6,523,703 B1 2/2003 Robertson
6,527,127 B2 3/2003 Dumontet
6,533,131 B2 3/2003 Bada
6,550,636 B2 4/2003 Simpson
6,553,702 B1 4/2003 Bacnik
6,554,143 B1 4/2003 Robertson
6,571,498 B1 6/2003 Cyrluk
6,598,754 B2 7/2003 Weiler
6,604,638 B1 8/2003 Primiano et al.
6,615,995 B2 9/2003 Primiano et al.
6,622,874 B1 9/2003 Hawkinson
6,637,604 B1 10/2003 Jay
6,648,151 B2 11/2003 Battaglia et al.
6,651,828 B2 11/2003 Dimattio et al.
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 1/2004 Robertson et al.
6,688,567 B2 2/2004 Fast et al.
6,691,891 B2 2/2004 Maldonado
6,695,152 B1 2/2004 Fabrizio et al.
6,715,621 B2 4/2004 Boron
6,722,509 B1 4/2004 Robertson et al.
6,739,461 B1 5/2004 Robinson
6,745,905 B2 6/2004 Bernstein
6,749,070 B2 6/2004 Corbett, Jr. et al.
6,749,084 B2 6/2004 Thompson
6,756,975 B1 6/2004 Kishida et al.
6,758,349 B1 7/2004 Kwap et al.
6,769,552 B1 8/2004 Thalenfeld
6,772,888 B2 8/2004 Burke
6,779,670 B2 8/2004 Primiano et al.
6,786,341 B2 9/2004 Stinnett et al.
6,793,185 B2 9/2004 Joliey
6,796,445 B2 9/2004 Cyrluk
6,799,523 B1 10/2004 Cunha
6,820,754 B2 11/2004 Ondrasik
6,823,997 B2 11/2004 Linden et al.
6,824,009 B2 11/2004 Hardy
6,830,146 B1 12/2004 Scully et al.
6,830,157 B2 12/2004 Robertson et al.
6,843,382 B2 1/2005 Kanouchi et al.
6,843,632 B1 1/2005 Hollander
6,860,046 B1 3/2005 Squitieri
6,866,156 B2 3/2005 Nagel et al.
6,867,824 B2 3/2005 Eiraku et al.
6,874,646 B2 4/2005 Jay
6,889,854 B2 5/2005 Burke
6,889,855 B2 5/2005 Nagel
6,902,285 B2 6/2005 Eiraku et al.
6,918,495 B1 7/2005 Hoy
6,918,736 B2 7/2005 Hart et al.
6,919,933 B2 7/2005 Zhang et al.
6,923,330 B1 8/2005 Nagel
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh et al.
7,007,790 B2 3/2006 Brannon
7,028,450 B2 4/2006 Hart et al.
7,028,852 B2 4/2006 Johnson et al.
7,063,217 B2 6/2006 Burke
7,080,969 B2 7/2006 Hart et al.
7,083,054 B2 8/2006 Squitieri
7,086,541 B2 8/2006 Robertson
7,093,546 B2 8/2006 Hardy
7,104,026 B2 9/2006 Welborn et al.
7,104,410 B2 9/2006 Primiano
7,108,143 B1 9/2006 Lin
7,111,914 B2 9/2006 Avendano
7,114,606 B2 10/2006 Shaw et al.
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,546 B2 1/2007 Plesh, Sr.

(56) References Cited

U.S. PATENT DOCUMENTS 7,168,579 B2 1/2007 Richter et al.
7,182,209 B2 2/2007 Squitieri
7,195,123 B2 3/2007 Roslof et al.
7,198,340 B1 4/2007 Ertz
7,200,903 B2 4/2007 Shaw et al.
7,201,281 B1 4/2007 Welker
7,216,770 B2 5/2007 Mueller et al.
7,229,143 B2 6/2007 Gilman
7,293,663 B2 11/2007 Lavery, Jr.
7,299,934 B2 11/2007 Hardy et al.
7,318,532 B1 1/2008 Lee et al.
7,347,335 B2 3/2008 Rankin, VI et al.
7,357,469 B2 4/2008 Ertz
7,395,938 B2 7/2008 Merit et al.
7,398,876 B2 7/2008 Vestergaard
7,404,494 B2 7/2008 Hardy
7,419,062 B2 9/2008 Mason
7,424,957 B1 9/2008 Luberto
7,451,881 B2 11/2008 Hardy et al.
7,458,473 B1 12/2008 Mason
7,478,731 B1 1/2009 Mason
7,497,342 B2 3/2009 Hardy
7,500,571 B2 3/2009 Hawkinson
7,530,452 B2 5/2009 Vestergaard
7,621,409 B2 11/2009 Hardy et al.
7,626,913 B2 12/2009 Usami
7,631,771 B2 12/2009 Nagel et al.
7,641,057 B2 1/2010 Mueller et al.
7,681,743 B2 3/2010 Hanretty et al.
7,681,744 B2 3/2010 Johnson
7,686,185 B2 3/2010 Zychinski
D613,101 S * 4/2010 Hardy ..... D6/515
7,703,614 B2 4/2010 Schneider et al.
7,717,276 B2 5/2010 Alves
7,768,399 B2 8/2010 Hachmann et al.
7,784,623 B2 8/2010 Mueller et al.
7,784,644 B2 8/2010 Albert et al.
7,792,711 B2 9/2010 Swafford, Jr. et al.
7,815,060 B2 10/2010 Iellimo
7,823,724 B2 11/2010 Mowe et al.
7,823,734 B2 11/2010 Hardy
7,828,158 B2 11/2010 Colelli et al.
7,882,969 B2 2/2011 Gerstner et al.
7,896,172 B1 3/2011 Hester
7,918,353 B1 4/2011 Luberto
7,931,156 B2 4/2011 Hardy
7,934,609 B2 5/2011 Alves et al.
7,954,635 B2 6/2011 Biondi et al.
7,980,398 B2 7/2011 Kahl et al.
7,993,088 B2 8/2011 Sonon et al.
8,016,139 B2 9/2011 Hanners et al.
8,025,162 B2 9/2011 Hardy
8,038,017 B2 10/2011 Close
8,096,427 B2 1/2012 Hardy
8,113,360 B2 2/2012 Olson
8,113,601 B2 2/2012 Hardy
D655,107 S 3/2012 Clark et al.
8,127,944 B2 3/2012 Hardy
8,162,154 B2 4/2012 Trulaske, Sr.
8,167,149 B2 5/2012 Wamsley et al.
8,177,076 B2 5/2012 Rataiczak, III et al.
8,215,520 B2 7/2012 Miller et al.
8,225,946 B2 7/2012 Yang et al.
8,240,486 B2 8/2012 Niederhuefner et al.
8,267,258 B2 9/2012 Allwright et al.
8,276,772 B2 10/2012 Kim
8,302,783 B1 11/2012 Harris et al.
8,312,999 B2 11/2012 Hardy
8,322,544 B2 12/2012 Hardy
8,333,285 B2 12/2012 Kiehnau et al.
8,342,340 B2 1/2013 Rataiczak, III et al.
8,360,253 B2 1/2013 Hardy
8,376,154 B2 2/2013 Sun
8,397,922 B2 3/2013 Kahl et al.
8,485,391 B2 7/2013 Vlastakis et al.
8,556,092 B2 10/2013 Valiulis et al.
8,573,379 B2 11/2013 Brugmann
8,579,123 B2 11/2013 Mueller et al.
8,622,227 B2 1/2014 Bird et al.
8,657,126 B1 2/2014 Loftin et al.
8,662,325 B2 3/2014 Davis et al.
8,739,984 B2 6/2014 Hardy
8,763,819 B2 7/2014 Theisen et al.
8,844,431 B2 9/2014 Davis et al.
8,967,394 B2 3/2015 Hardy et al.
8,973,765 B2 3/2015 Wamsley et al.
8,978,904 B2 3/2015 Hardy
9,016,483 B2 4/2015 Howley
9,060,624 B2 6/2015 Hardy
9,138,075 B2 9/2015 Hardy et al.
9,149,132 B2 10/2015 Hardy
9,173,504 B2 11/2015 Hardy
9,259,102 B2 2/2016 Hardy et al.
9,265,362 B2 2/2016 Hardy
9,445,675 B1 * 9/2016 DeSena ..... A47F 1/126
9,486,088 B2 11/2016 Hardy et al.
9,668,590 B1 * 6/2017 Bruegmann ..... A47F 1/126
2001/0002658 A1 6/2001 Parham
2001/0010302 A1 8/2001 Nickerson
2001/0017284 A1 8/2001 Watanabe
2001/0019032 A1 9/2001 Battaglia et al.
2001/0020604 A1 9/2001 Battaglia et al.
2001/0020606 A1 9/2001 Battaglia et al.
2001/0042706 A1 11/2001 Ryan et al.
2001/0045403 A1 11/2001 Robertson
2001/0054297 A1 12/2001 Credle et al.
2002/0036178 A1 3/2002 Tombu
2002/0066706 A1 6/2002 Robertson
2002/0088762 A1 7/2002 Burke
2002/0108916 A1 8/2002 Nickerson
2002/0148794 A1 10/2002 Marihugh
2002/0170866 A1 11/2002 Johnson et al.
2002/0179553 A1 12/2002 Squitieri
2002/0182050 A1 12/2002 Hart et al.
2002/0189201 A1 12/2002 Hart et al.
2002/0189209 A1 12/2002 Hart et al.
2003/0000956 A1 1/2003 Maldonado
2003/0007859 A1 1/2003 Hart et al.
2003/0010732 A1 1/2003 Burke
2003/0024889 A1 2/2003 Dumontet
2003/0057167 A1 3/2003 Johnson et al.
2003/0061973 A1 4/2003 Bustos
2003/0066811 A1 4/2003 Dimattio et al.
2003/0080075 A1 5/2003 Primiano et al.
2003/0084827 A1 5/2003 Nicholson et al.
2003/0085187 A1 5/2003 Johnson et al.
2003/0106867 A1 6/2003 Caterinacci
2003/0132178 A1 7/2003 Jay et al.
2003/0132182 A1 7/2003 Jay
2003/0136750 A1 7/2003 Fujii et al.
2003/0141265 A1 7/2003 Jo et al.
2003/0150829 A1 8/2003 Linden et al.
2003/0168420 A1 9/2003 Primiano
2003/0201203 A1 10/2003 Fast et al.
2003/0217980 A1 11/2003 Johnson et al.
2003/0226815 A1 12/2003 Gaunt et al.
2004/0000528 A1 1/2004 Nagel
2004/0004046 A1 1/2004 Primiano et al.
2004/0011754 A1 1/2004 Zadak
2004/0020879 A1 2/2004 Close
2004/0065631 A1 4/2004 Nagel
2004/0079715 A1 4/2004 Richter et al.
2004/0084390 A1 5/2004 Bernstein
2004/0094493 A1 5/2004 Higgins
2004/0104239 A1 6/2004 Black et al.
2004/0105556 A1 6/2004 Grove
2004/0118793 A1 6/2004 Burke
2004/0118795 A1 6/2004 Burke
2004/0140276 A1 7/2004 Waldron
2004/0140278 A1 7/2004 Mueller et al.
2004/0140279 A1 7/2004 Mueller et al.
2004/0178156 A1 9/2004 Knowing et al.
2004/0182805 A1 9/2004 Harper
2004/0200793 A1 10/2004 Hardy

(56) References Cited

U.S. PATENT DOCUMENTS

2004/0206054 A1 10/2004 Welborn et al.
2004/0232092 A1 11/2004 Cash
2004/0245197 A1 12/2004 McElvaney
2004/0247422 A1 12/2004 Neumann et al.
2004/0255500 A1 12/2004 Fast et al.
2005/0035075 A1 2/2005 Walker
2005/0040123 A1 2/2005 Ali
2005/0072657 A1 4/2005 Lawless et al.
2005/0072747 A1 4/2005 Roslof et al.
2005/0076817 A1 4/2005 Boks et al.
2005/0077259 A1 4/2005 Menz
2005/0092702 A1 5/2005 Nagel
2005/0098515 A1 5/2005 Close
2005/0127014 A1 6/2005 Richter et al.
2005/0133471 A1 6/2005 Squitieri
2005/0139560 A1 6/2005 Whiteside et al.
2005/0150847 A1 7/2005 Hawkinson
2005/0188574 A1 9/2005 Lowry
2005/0189310 A1 9/2005 Richter et al.
2005/0199563 A1 9/2005 Richter et al.
2005/0199564 A1 9/2005 Johnson et al.
2005/0199565 A1 9/2005 Richter et al.
2005/0218094 A1 10/2005 Howerton et al.
2005/0224437 A1 10/2005 Lee
2005/0249577 A1 11/2005 Hart et al.
2005/0258113 A1 11/2005 Close et al.
2005/0263465 A1 12/2005 Chung
2005/0286700 A1 12/2005 Hardy
2006/0001337 A1 1/2006 Walburn
2006/0032827 A1 2/2006 Phoy
2006/0049122 A1 3/2006 Mueller et al.
2006/0049125 A1 3/2006 Stowell
2006/0104758 A1 5/2006 Hart et al.
2006/0163180 A1 7/2006 Rankin et al.
2006/0163272 A1 7/2006 Gamble
2006/0186064 A1 8/2006 Merit et al.
2006/0186065 A1 8/2006 Ciesick
2006/0186066 A1 8/2006 Johnson et al.
2006/0196840 A1 9/2006 Jay et al.
2006/0213852 A1 9/2006 Kwon
2006/0226095 A1 10/2006 Hardy
2006/0237381 A1 10/2006 Lockwood et al.
2006/0260518 A1 11/2006 Josefsson et al.
2006/0263192 A1 11/2006 Hart et al.
2006/0273053 A1 12/2006 Roslof et al.
2006/0283150 A1 12/2006 Hart et al.
2006/0283151 A1 12/2006 Welborn et al.
2007/0006885 A1 1/2007 Shultz et al.
2007/0029270 A1 2/2007 Hawkinson
2007/0068885 A1 3/2007 Busto et al.
2007/0075028 A1* 4/2007 Nagel ..... A47F 3/0486 211/59.2
2007/0108142 A1 5/2007 Medcalf et al.
2007/0108146 A1 5/2007 Nawrocki
2007/0119798 A1* 5/2007 Hanretty ..... A47F 1/12 211/59.2
2007/0119799 A1* 5/2007 Hanretty ..... A47F 1/12 211/59.2
2007/0138114 A1 6/2007 Dumontet
2007/0170127 A1 7/2007 Johnson
2007/0175839 A1 8/2007 Schneider et al.
2007/0175844 A1 8/2007 Schneider
2007/0187344 A1 8/2007 Mueller et al.
2007/0194037 A1 8/2007 Close
2007/0251905 A1 11/2007 Trotta
2007/0256992 A1 11/2007 Olson
2007/0267364 A1 11/2007 Barkdoll
2007/0272634 A1 11/2007 Richter et al.
2007/0278164 A1 12/2007 Lang et al.
2008/0000859 A1 1/2008 Yang et al.
2008/0011696 A1 1/2008 Richter et al.
2008/0017598 A1 1/2008 Rataiczak et al.
2008/0129161 A1 6/2008 Menz et al.
2008/0142458 A1 6/2008 Medcalf
2008/0156751 A1 7/2008 Richter et al.
2008/0156752 A1 7/2008 Bryson et al.
2008/0164229 A1 7/2008 Richter et al.
2008/0250986 A1 10/2008 Boon
2008/0296241 A1 12/2008 Alves et al.
2008/0314852 A1 12/2008 Richter et al.
2009/0020548 A1 1/2009 VanDruff
2009/0084812 A1 4/2009 Kirschner
2009/0101606 A1 4/2009 Olson
2009/0248198 A1 10/2009 Siegel et al.
2009/0272705 A1 11/2009 Francis
2009/0277853 A1 11/2009 Bauer
2010/0012602 A1 1/2010 Valiulis et al.
2010/0072152 A1 3/2010 Kim
2010/0078402 A1 4/2010 Davis et al.
2010/0089847 A1 4/2010 Rataiczak, III et al.
2010/0096345 A1 4/2010 Crawbuck et al.
2010/0107670 A1 5/2010 Kottke et al.
2010/0108624 A1 5/2010 Sparkowski
2010/0133214 A1 6/2010 Evans
2010/0176075 A1 7/2010 Nagel et al.
2010/0200526 A1 8/2010 Barkdoll
2010/0206829 A1 8/2010 Clements et al.
2010/0252519 A1 10/2010 Hanners et al.
2010/0258513 A1 10/2010 Meyer et al.
2010/0276383 A1 11/2010 Hardy
2011/0121022 A1 5/2011 Sholl et al.
2011/0147323 A1* 6/2011 Sainato ..... A47F 1/12 211/59.2
2011/0168652 A1 7/2011 Barkdoll
2011/0174750 A1 7/2011 Poulokefalos
2011/0204012 A1 8/2011 Eguchi et al.
2011/0215060 A1 9/2011 Niederhuefner
2011/0218889 A1 9/2011 Westberg et al.
2011/0220597 A1 9/2011 Sherretts et al.
2011/0284571 A1 11/2011 Lockwood et al.
2011/0304316 A1 12/2011 Hachmann et al.
2012/0074088 A1 3/2012 Dotson et al.
2012/0090208 A1 4/2012 Grant
2012/0091162 A1 4/2012 Overhultz et al.
2012/0118840 A1 5/2012 Howley
2012/0217212 A1 8/2012 Czalkiewicz et al.
2012/0255922 A1* 10/2012 Bryson ..... A47F 1/126 211/59.3
2012/0285916 A1 11/2012 O'Quinn et al.
2013/0015155 A1 1/2013 Brugmann
2013/0026117 A1 1/2013 Hardy
2013/0037562 A1 2/2013 Close
2013/0200019 A1* 8/2013 Hardy ..... A47F 1/126 211/59.3
2013/0200026 A1* 8/2013 Bryson ..... A47F 5/10 211/126.14
2013/0206713 A1 8/2013 Hardy
2013/0213916 A1 8/2013 Leahy et al.
2013/0270204 A1* 10/2013 Bird ..... A47F 1/04 211/59.3
2014/0008382 A1 1/2014 Christianson
2014/0091696 A1 4/2014 Welker et al.
2014/0124463 A1* 5/2014 Goehring ..... A47F 1/12 211/49.1
2014/0138330 A1* 5/2014 Hardy ..... A47F 1/126 211/59.3
2014/0151313 A1* 6/2014 Breslow ..... A47F 1/04 211/59.3
2014/0305891 A1 10/2014 Vogler et al.
2014/0319088 A1 10/2014 Neumann et al.
2014/0326691 A1 11/2014 Hardy
2014/0360953 A1 12/2014 Pichel
2015/0034576 A1 2/2015 Wong
2015/0090675 A1 4/2015 Vosshernrich
2015/0320237 A1 11/2015 Hardy et al.
2017/0020302 A1* 1/2017 Goehring ..... A47F 1/125

FOREIGN PATENT DOCUMENTS

BE 906083 A2 4/1987
BE 1013877 A6 11/2002
CH 394537 A * 6/1965 ..... A47B 65/00
CH 412251 A 4/1966

(56) References Cited

FOREIGN PATENT DOCUMENTS

| | | | |
|---|---|---|---|
| CN | 2642158 | Y | 9/2004 |
| CN | 101472509 | A | 7/2009 |
| DE | 969003 | C | 4/1958 |
| DE | 1819158 | U | 10/1960 |
| DE | 2002720 | A1 | 7/1971 |
| DE | 7311113 | U | 8/1973 |
| DE | 2232398 | A1 | 1/1974 |
| DE | 2825724 | A1 | 12/1979 |
| DE | 8308485 | U1 | 9/1983 |
| DE | 3211880 | A1 | 10/1983 |
| DE | 8426651 | U1 | 2/1985 |
| DE | 8520125 | U1 | 1/1986 |
| DE | 8717386 | U1 | 3/1988 |
| DE | 8717386.7 | | 4/1988 |
| DE | 3707410 | A1 | 9/1988 |
| DE | 9300431.1 | | 3/1993 |
| DE | 29618870 | U1 | 12/1996 |
| DE | 29902688 | U1 | 7/1999 |
| DE | 19808162 | A1 | 9/1999 |
| DE | 202007011927 | U1 | 11/2007 |
| DE | 202013102529 | U1 | 6/2013 |
| EP | 0004921 | A1 | 10/1979 |
| EP | 0018003 | A2 | 10/1980 |
| EP | 69003 | A1 | 1/1983 |
| EP | 0176209 | A2 | 4/1986 |
| EP | 0224107 | A2 | 6/1987 |
| EP | 270016 | A2 | 6/1988 |
| EP | 298500 | A2 | 1/1989 |
| EP | 336696 | A2 | 10/1989 |
| EP | 0337340 | A2 | 10/1989 |
| EP | 0408400 | A1 | 1/1991 |
| EP | 0454586 | A1 | 10/1991 |
| EP | 478570 | A1 | 4/1992 |
| EP | 555935 | A1 | 8/1993 |
| EP | 0568396 | A1 | 11/1993 |
| EP | 0587059 | A2 | 3/1994 |
| WO | WO-2016124760 | A1 * | 8/2016 ..... A47F 5/005 |

OTHER PUBLICATIONS

Sep. 25, 2015—(CA) Examiner's Report—App 2847521.
Feb. 9, 2016—(AU) Office Action—App. 2014228865.
Apr. 19, 2016—(EP) Office Action—App. 15172675.
*RTC Industries, Inc.* v. *FFR Merchandising, Inc.*, Complaint, Case: 1 :17-cv-03595 Document #:1 Filed: May 12, 2017 p. 1 of 10 Page ID #:1.
Mar. 22, 2016—(WO) International Search Report and Written Opinion—App PCT/US2015/067494.

* cited by examiner

ANTI-SPLAY DEVICE FOR MERCHANDISE DISPLAY SYSTEM

RELATED APPLICATIONS

This application claims priority to U.S. Provisional Application No. 62/278,312, filed on Jan. 13, 2016, and relates to U.S. application Ser. No. 14/611,767, filed on Feb. 2, 2015, which is a continuation of U.S. application Ser. No. 13/833,500, filed on Mar. 15, 2013, and granted as U.S. Pat. No. 8,967,394, which is a continuation-in-part of U.S. application Ser. No. 13/542,419 filed on Jul. 5, 2012, and granted as U.S. Pat. No. 8,739,984, which is a is a continuation-in-part of U.S. application Ser. No. 12/639,656 filed Dec. 16, 2009, and granted as U.S. Pat. No. 8,322,544, which is a continuation-in-part application of U.S. application Ser. No. 12/357,860 filed Jan. 22, 2009, and granted as U.S. Pat. No. 8,453,850, which is a continuation-in-part application of U.S. application Ser. No. 11/760,196 filed Jun. 8, 2007, and granted as U.S. Pat. No. 8,312,999, which is a continuation-in-part application of U.S. application Ser. No. 11/411,761 filed Apr. 25, 2006, and granted as U.S. Pat. No. 7,823,734, which claims benefit to U.S. Provisional Application Nos. 60/716,362 filed Sep. 12, 2005 and 60/734,692 filed Nov. 8, 2005, all of which are incorporated herein fully by reference. U.S. application Ser. No. 13/542,419 also claims benefit to U.S. Provisional Application Nos. 61/530,736 filed Sep. 2, 2011, 61/542,473 filed Oct. 3, 2011, and 61/553,545 filed Oct. 31, 2011. All of the above applications are incorporated herein fully by reference.

FIELD

The exemplary embodiments relate generally to a shelf assembly for use in merchandising product and more particularly to a shelf assembly having improved mechanisms for displaying and pushing product on the shelves.

BACKGROUND

Retail and wholesale stores, such as convenience stores, drug stores, grocery stores, discount stores, and the like, require a large amount of shelving both to store product and to display the product to consumers. In displaying product, it is may be desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it may be desirable for these products to also be situated toward the front of the shelf and visible and accessible to the consumers.

To accomplish this placement of product, systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. Other systems may include the use of a pusher system to push the product toward the front of the shelf as the product at the front of the shelf is removed. Pusher systems can be mounted to a track and may include a pusher paddle and a coiled spring to urge the product forward.

SUMMARY

One exemplary embodiment described herein is directed to a product management display system for merchandising product on a shelf and displaying and merchandising product to a consumer. In one example, the merchandising display system is configured to display product in rows by use of divider assemblies while maintaining the spacing between the rows during dispensing of the product. The example merchandising display system can include one or more of a front rail, divider assemblies, a central track or floor, and a pusher assembly. In one example aspect, the example merchandising display system can be configured to prevent splaying or separating of the divider assemblies, when a row of product is loaded toward the rear of the shelf or when the rows of product are displayed to consumers. In one example, the central track in conjunction with the weight of the product can be configured to help maintain even spacing between the first divider assembly and the second divider assembly, such that the first divider assembly and the second divider assembly are better maintained in position on the shelf thereby helping to maintain the product organized in their respective rows on the shelf.

Figure 1:
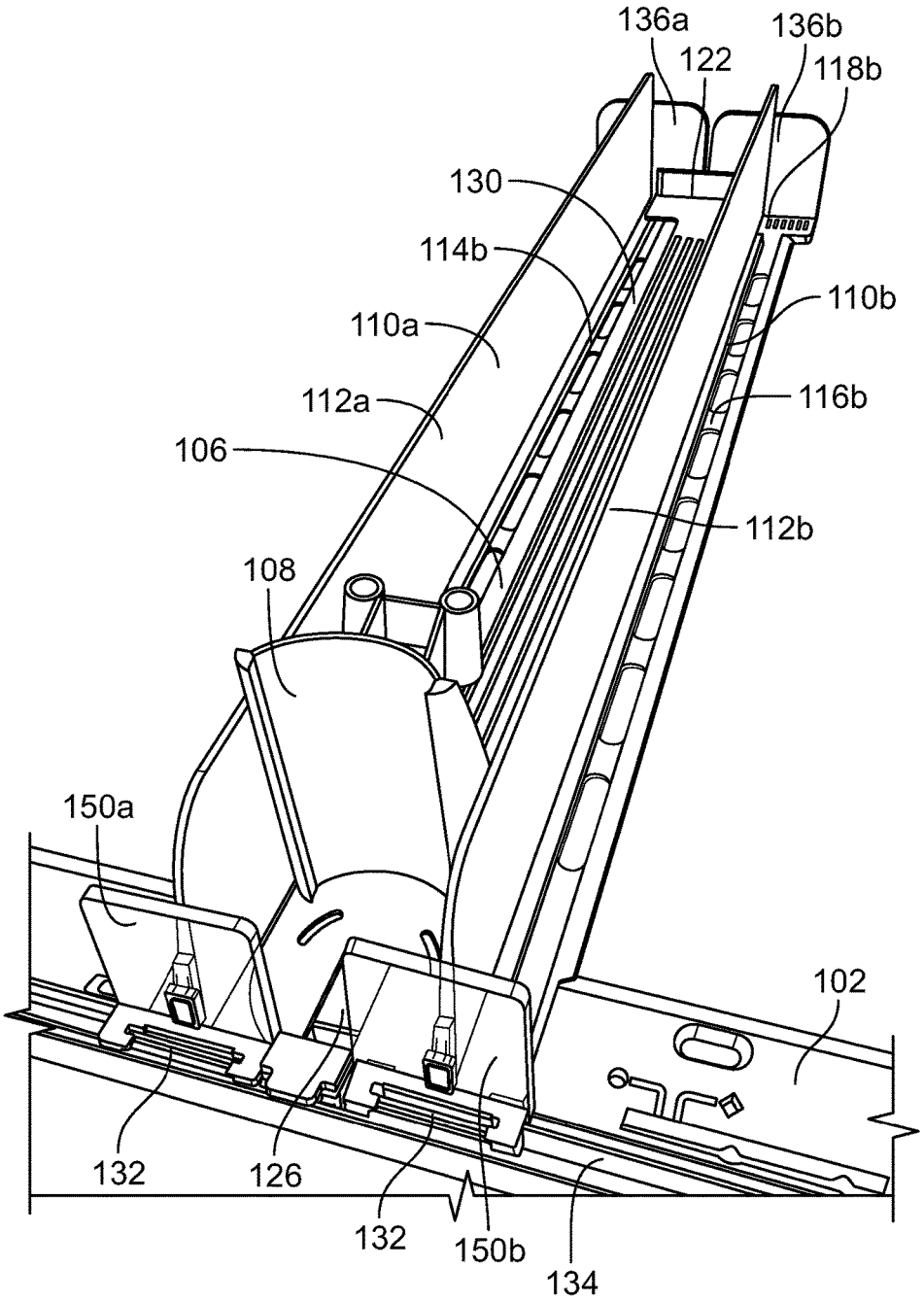
FIG. 1 depicts a right-side isometric view of an example product management display system in a first position.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

Also, while the terms "front," "back," "rear," "side," "forward," "rearward," and "backward" and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the disclosure.

DETAILED DESCRIPTION

The disclosure may be embodied in various forms. Referring to the Figures wherein like numerals indicate like elements, FIGS. 1-6 depict an example anti-splay merchandising display system 100, for displaying and merchandising product to a consumer. The merchandising display system 100 is configured to display product in rows by use of divider assemblies while maintaining the spacing between the rows during dispensing of the product.

Figure 2:
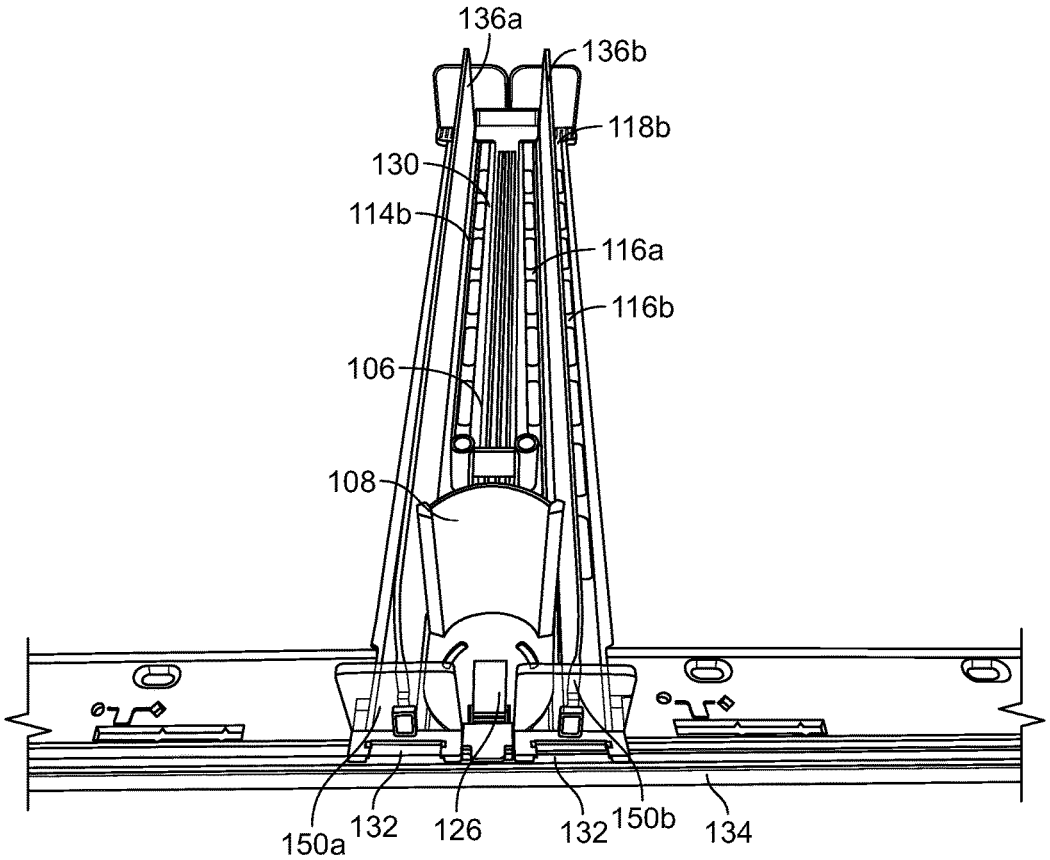
FIG. 2 depicts a front isometric view of the example product management display system of FIG. 1.
Figure 4:
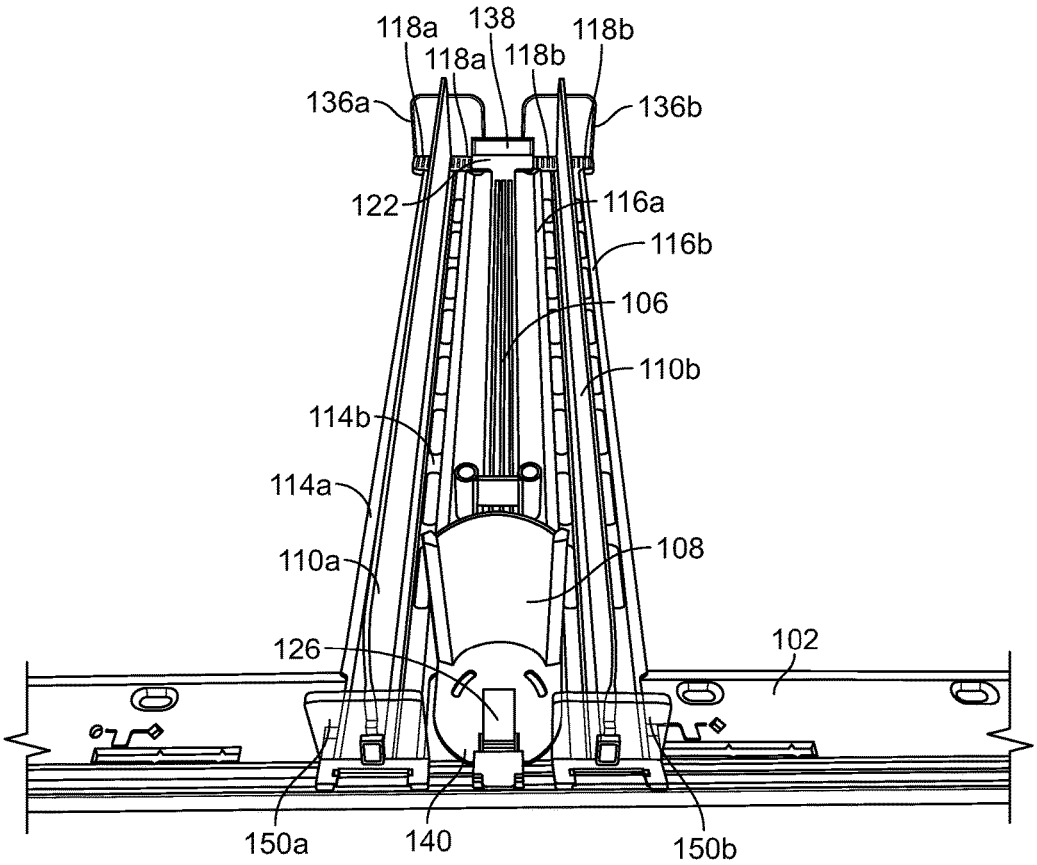
FIG. 4 depicts a front isometric view of the example product management display system of FIG. 1 in a second position.

As shown in FIGS. 1, 2, and 4, the example merchandising display system 100 can include a front rail 102, identical first and second divider assemblies 110*a*, 110*b*, and a central track or floor 106 accommodating a pusher assembly 108. Product can be placed in rows between the first divider assembly 110*a* and the second divider assembly 110*b* and on the central track 106 of the merchandising display system 100. When a first product located in the front of a particular row is removed, the pusher assembly 108 advances the entire row of product remaining in the row toward first and second product barriers 150*a*, 150*b* until the next product abuts the first and second product barriers 150*a*, 150*b*. Although only two divider assemblies 110*a*, 110*b* and one central track 106 are depicted in the Figures, it is contemplated that more than two divider assemblies and multiple central tracks can be provided along the rail 102 to accommodate several rows of product.

The example merchandising display system 100 is configured to prevent splaying or separating of the divider assemblies 110*a*, 110*b*, particularly when a row of product is loaded toward the rear of the shelf. As is discussed in more detail below, the central track 106 in conjunction with the weight of the product are configured to maintain the spacing of the first divider assembly 110*a* and the second divider assembly 110*b*, to help maintain the first divider assembly 110*a* and the second divider assembly 110*b* in position on the shelf thereby helping to maintain the product organized in their respective rows on the shelf.

Figure 3:
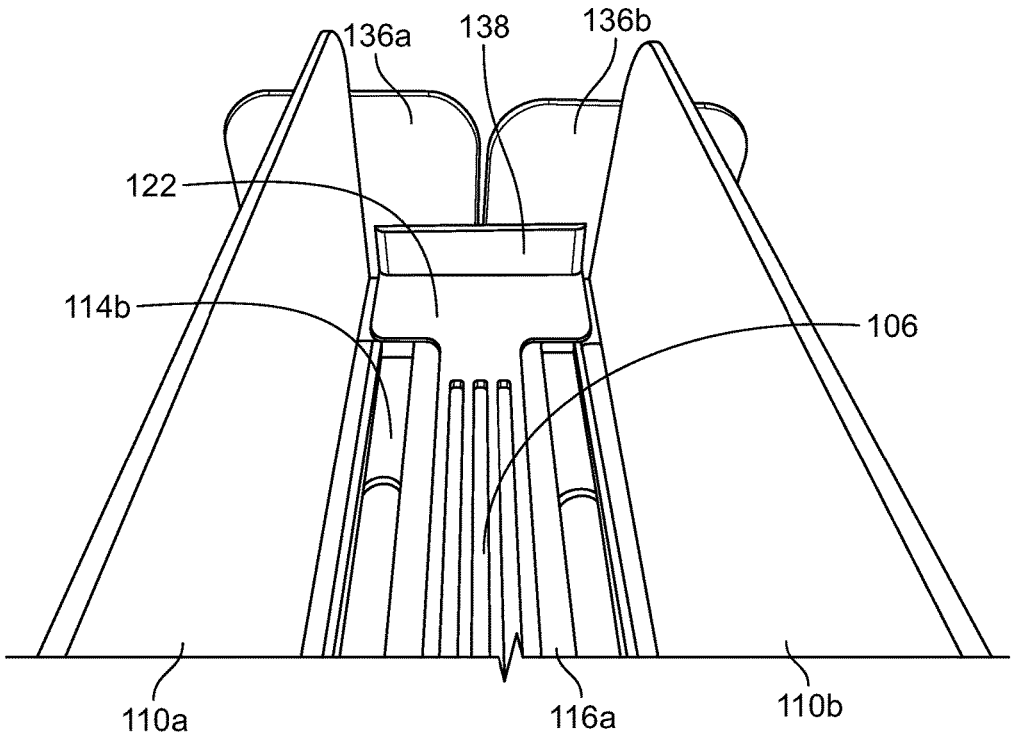
FIG. 3 depicts another isometric view of a rear section of the example product management display system of FIG. 1.
Figure 5:
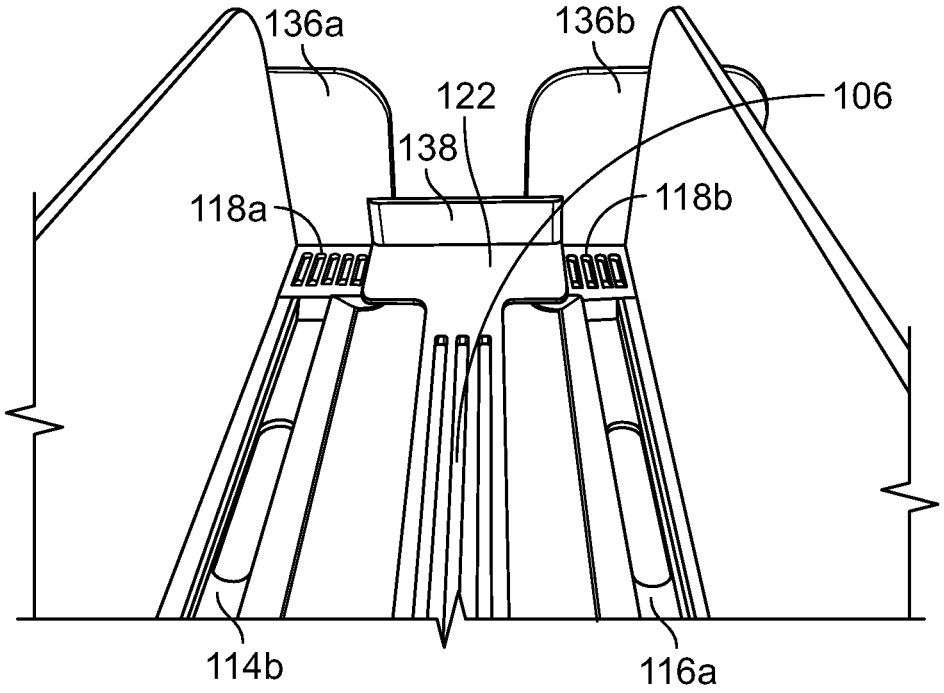
FIG. 5 depicts another isometric view of a rear section of the example product management display system of FIG. 1 in the second position.

The merchandising display system 100 can also be configured to be adjusted to accommodate different sized product and can be positioned in any desired location along the front rail 102. In particular, the spacing between the first divider assembly 110*a* and the second divider assembly 110*b* can be adjustable relative to each other. The first divider assembly 110*a*, the second divider assembly 110*b*, and the central track 106 can each be configured to slide along the front rail 102 to any desired position, and once in the desired position can be locked into place onto the front rail 102 by way of cams 132. For example, FIGS. 1-3 show the example merchandising display system 100 in a first position to accommodate product of a first width, and FIGS. 4 and 5 show the example merchandising display system 100 in a second position to accommodate product of a second width.

The first divider assembly 110*a* can be provided with a first divider wall 112*a* separating the first divider assembly into sections to define a first pair of floors 114*a*, 114*b*, which provide a first track and a second track for supporting product on either side of the first divider wall 112*a*. Likewise, the second divider assembly 110*b* can include a second divider wall 112*b* separating the second divider assembly 110*b* into sections to define a second pair of floors 116*a*, 116*b* to provide a third track and a forth track for supporting product. Additionally, as shown in FIGS. 1-5, the central track 106 can be configured to sit on top of one of the first divider floors 114*b* and one of the second divider floors 116*a* in a position to accommodate the corresponding width of the product in the row. The central track 106 is configured to extend between the first divider assembly 110*a* and the second divider assembly 110*b*. Together the first divider floor 114*b*, the second divider floor 116*a*, and the central track 106 define a floor 130 for receiving a row of product. In one example, when positioned in the smallest setting, the floor 106, the second track 114*b*, and the third track 116*a* can form an integral surface for receiving product. However, in other settings, for example as shown in FIG. 4, the central track 106 can be spaced apart from the second track 114*b* and the third track 116*a*.

The central track 106 can include an outwardly extending flange or tail 122. The outwardly extending flange 122 engages the first divider assembly 110*a* at the first divider assembly rear and the floor 106 engages the second divider assembly 110*b* at the second divider assembly rear to prevent the first divider assembly 110*a* and the second divider assembly 110*b* from splaying in relation to one another. This helps to maintain the product neatly in rows on the shelves in between the first divider wall 112*a* of the first divider assembly 110*a* and the second divider wall 112*b* of the second divider assembly 110*b*.

In one example, the rear portion of each of a first pair of floors 114*a*, 114*b* of the first divider assembly 110*a* and the rear portion of each of the second pair of floors 116*a*, 116*b* of the second pair of floors 116*a*, 116*b* of the second divider assembly 110*b* can be provided with a plurality of notches 118*a*, 118*b* for accommodating various different sized product. The notches are configured to receive corresponding projections 120*a*, 120*b* on the flange of the central track 106.

Figure 6:
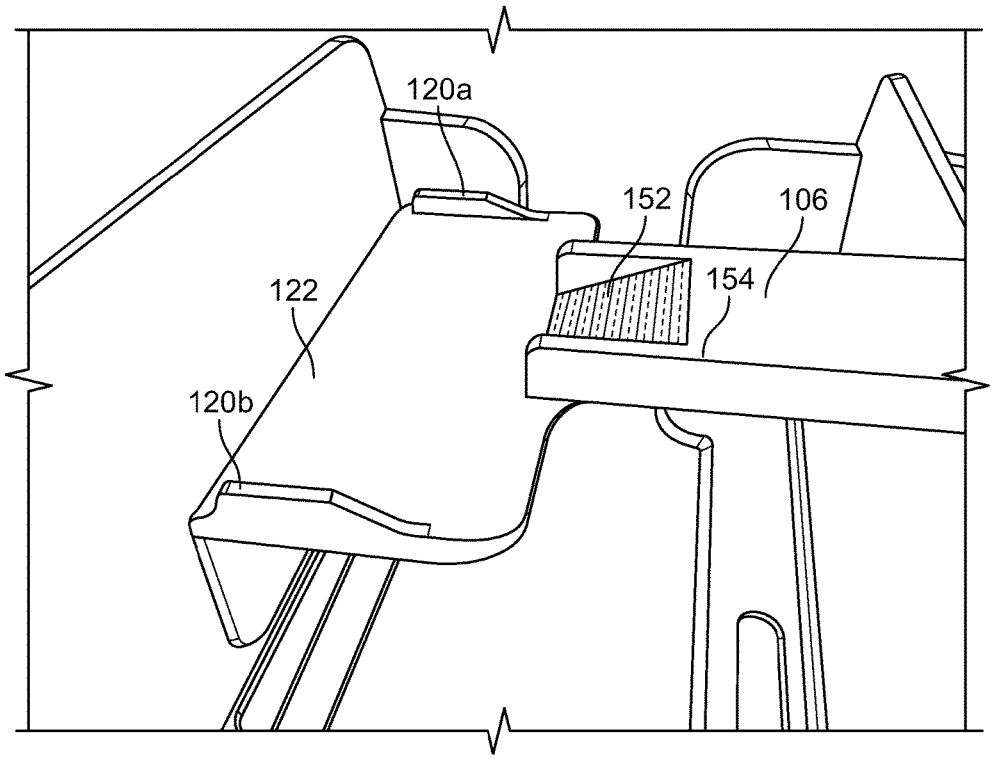
FIG. 6 depicts another isometric view of a bottom rear section of the floor of the example product management display system of FIG. 1.

As shown in FIG. 6, the flange or tail 122 on the central track 106 can include a first tooth or projection 120*a* and a second tooth or projection 120*b*. Both the first projection 120*a* and the second projection 120*b* can be oriented vertically on the flange 122. The first projection 120*a* can be configured to align with and rest within one of the plurality of notches 118*a* on the second track 114*b* on the first divider assembly 110*a*. Similarly, the second projection 120*b* can be configured to align with and rest within one of the plurality of notches 118*b* in the third track 116*a* on the second divider assembly 110*b*.

Also as shown in FIG. 6, the central track 106 can be provided with an extended base area 154, which can be received in between the first divider assembly 110*a* and the second divider assembly 110*b* and acts as a spacing guide for the first divider assembly 110*a* and the second divider assembly 110*b* when the divider assemblies 110*a*, 110*b* are in the smallest setting. The central track 106 can be provided with a ramp 152. It is also contemplated that the flange 122 can be provided with multiple projections that can be received in multiple openings in the first divider assembly 110*a* and the second divider assembly 110*b* to provide additional traction between the central track 106, the first divider assembly 110*a*, and the second divider assembly 110*b*. This can help increase the retention forces between the central track 106, the first divider assembly 110*a*, and the second divider assembly 110*b* and the ability of the central track 106 to prevent splaying of the first divider assembly 110*a* and the second divider assembly 110*b* when product is loaded therein.

As discussed herein, the central track 106 sits on top of the one of the first pair of floors 114*a*, 114*b* of the first divider assembly 110*a* and one of the second pair of floors 116*a*, 116*b* of the second divider assembly 110*b* at their respective rear portions. The first divider assembly 110*a* and the second divider assembly 110*b* can be arranged relative to each other to the corresponding width of the product. As product is loaded from the front of the shelf, the pusher assembly 108 moves backwards on the central track 106, and the weight of the product itself causes the first projection 120*a* and the second projection 120*b* on the flange 122 of the central track 106 to engage the notches 118*a*, 118*b* of the first divider assembly 110*a* and the second divider assembly 110*b* respectively. When product is pushed toward the rear of the shelf, splaying can become more prevalent, and this configuration essentially locks the divider assemblies 110*a*, 110*b* together at the rear automatically. This example can be easier to implement in that arranging the divider assemblies simply requires that the divider assemblies 110*a*, 110*b* be oriented according to the width of the product, and the central track 10 be placed on the divider assemblies at the desired width.

In addition, the flange or tail 122 can be provided with an upstanding rear portion 138. The rear portion 138 can help to prevent product from falling off of the rear portion of the shelf. In combination with the projections 120*a*, 120*b* described above or in the alternative, although not shown, the rear portion 138 may also be provided with a series of projections that can fit within corresponding notches on the first and second rear product barriers 136*a*, 136*b*. Moreover, the rear portion 138 can also be provided with a texturized surface to also help prevent the divider assemblies 110*a*, 110*b* from splaying.

The central track 106 can also support the pusher assembly 108. The pusher assembly 108 can be any type of pusher assembly and can be configured according to the type of product that is being merchandised in the merchandising display system 100. For example, the pusher assembly 108 can be any of the pusher examples disclosed in U.S. application Ser. No. 14/611,767, incorporated by reference above. The pusher 108 can be held onto the central track 106 by only the coiled spring. Also the central track 106 can include a guide or track and the pusher assembly 108 can include a corresponding projection that engages the guide or track located on the central track 106.

In one example, the pusher assembly 108 can include a pusher floor 140, a pusher paddle 124, and a coiled spring 126 positioned behind the pusher paddle 124. The coiled spring 126 is configured to bias the pusher assembly 108 toward the front rail 102 and the barriers 150*a*, 150*b*. In this example, the pusher paddle 124 can be mounted to the central track 106 and can be configured to bias product toward a front of a shelf such that a consumer can easily remove the product from the front of the shelf.

At a front portion, each of the first divider assembly 110*a*, the second divider assembly 110*b*, and the central track 106 can be configured to connect to the front rail 102 by way of various connections. The types of connections may include a cam or lock that engages the front rail 102, which are shown and described in U.S. application Ser. No. 14/611,767, fully incorporated by reference above. In this example, the divider assemblies 110*a*, 110*b* can be provided with a separate cam 132. The cam 132 can be configured to move between a first position and a second position for selective engagement with a groove or channel 134 in the front rail 102. When the respective cam 132 is in the first position and the particular component (e.g. the first divider assembly 110*a* or the second divider assembly 110*b*) is on the rail, the particular component can be (a) movable in a lateral direction parallel to the front rail 102 and (b) secured in a direction perpendicular to the front rail 102. However, when the respective cam 132 is in the second position and the particular component is engaged with the rail, the particular component is (a) fixed in the lateral direction parallel to the front rail 102 and (b) secured in the direction perpendicular to the front rail 102.

Figure 7A:
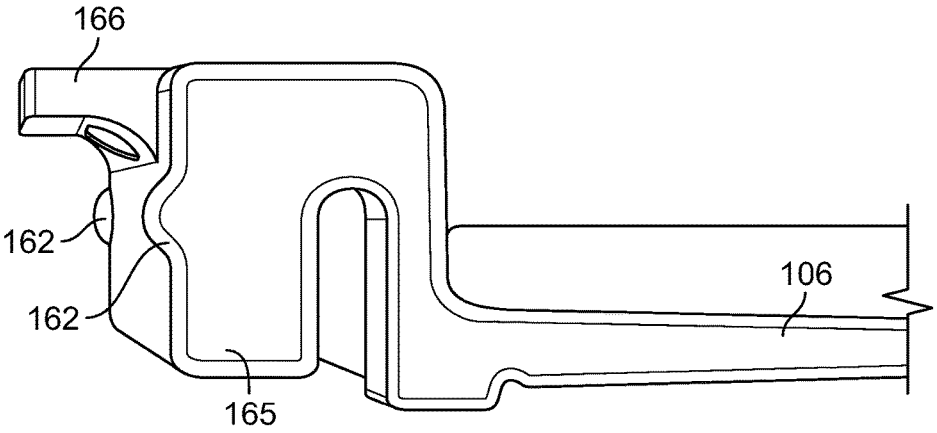
FIG. 7*a* shows a side-perspective view of a front portion of an example central track.
Figure 7B:
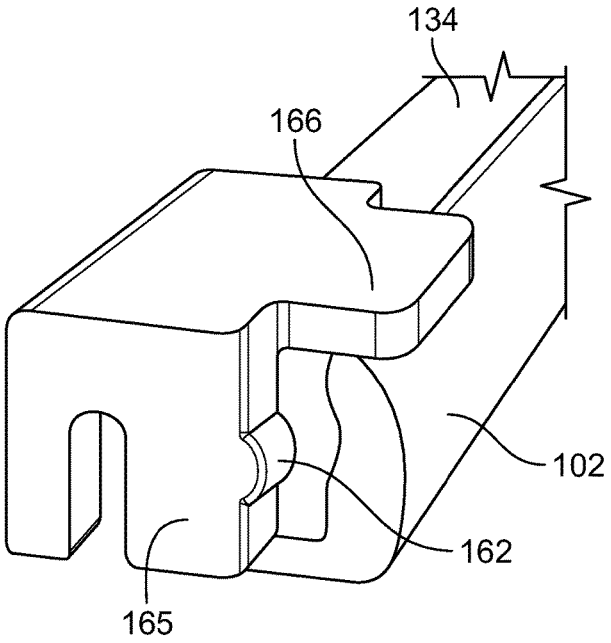
FIG. 7*b* shows another side-perspective view of a front portion of the example central track of FIG. 7*a*.
Figure 8:
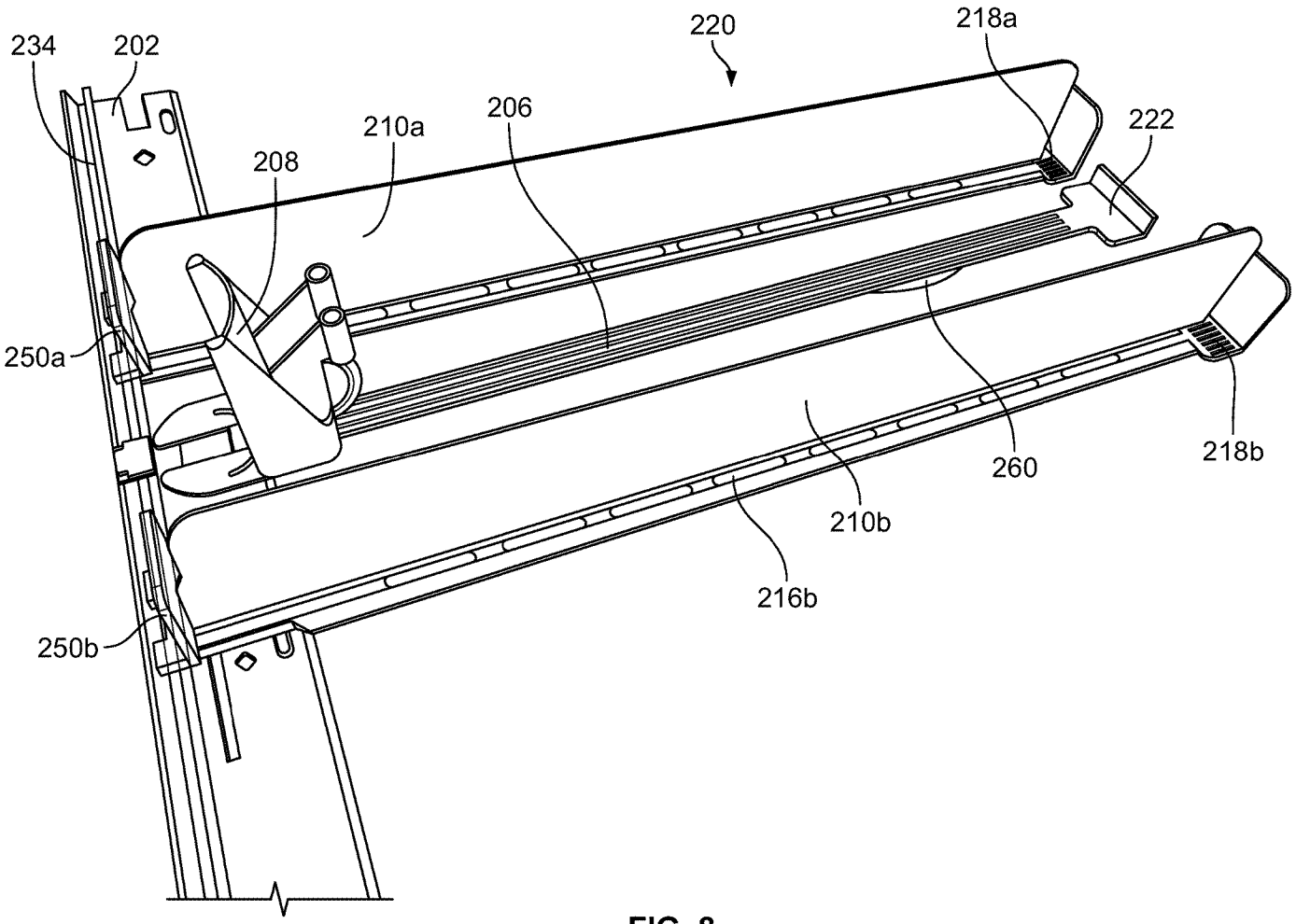
FIG. 8 shows a front perspective view of another example merchandise display system.

In one example, the central track 106 can be secured to the front rail 102 by a friction-engagement-type fit that allows the central track 106 to be fixed to the front rail 102 and to also move along the front rail 102 for adjusting the product management display system 100 to receive product therein. Specifically, as shown in FIGS. 7*a* and 7*b*, the front of the central track 106 can be provided with an extension 165 having a pair of semi-ocular protrusions 162, which are configured to fit into the front rail groove or channel 134. Together the extension 165 and the semi-ocular protrusions 162 provide a frictional fit into the front rail groove or channel 134. Additionally, the extension 165 can be provided with a tab 166 for the user to grasp the front portion of the central track 106 such that the central track 106 can be placed onto, removed from, or slid along the front rail 102. The extension 165 and the semi-ocular protrusions 162 allows for user to slide the central track 106 along the front rail 102 in order to center the central track 106 once the divider assemblies 110*a*, 110*b* have been sized to the container width.

In one example, the extension 165, the semi-ocular protrusions 162, and the tab 166 can be formed of an elastomeric material, which allows for the extension 165 and the semi-ocular protrusions 162*a*, 162*b* to sufficiently flex when placed into the front rail groove or channel 134. Moreover, the front rail 102 can be formed of a flexible material, such as a suitable plastic in order to also flex when the extension 165 and the semi-ocular protrusions 162 are received within the groove 134. It is also contemplated that the central track 106 can connect to the front rail 102 using other connection methods. For example, the central track 106 can be provided with a similar cam and lock system as the divider assemblies discussed above with respect to the divider assemblies 110*a*, 110*b* for securing the central track 106 to the front rail.

Additionally, product can be prevented from sliding off of the front or the rear of the shelf. Specifically, the first and second product barriers 150*a*, 150*b* can be affixed to the first divider assembly 110*a* and the second divider assembly 110*b* respectively. Additionally, the first divider assembly 110*a* and the second divider assembly 110*b* can be provided with integral first and second rear product barriers 136*a*, 136*b* to prevent product from being displaced off of the rear of shelves.

Additionally, the merchandising display system 110 can be configured to support several rows of the same or different product. Although not shown, another central track can be placed on top of either the other of the first pair of floors 114*a*, 114*b* of the first divider assembly 110*a*, or another central track can be placed in on the other one of the second pair of floors 116*a*, 116*b* of the second divider assembly 110*b*. Furthermore, another divider assembly can be provided to accommodate the central track on the other side and can be arranged for receiving any width of product therein.

For example, in addition to the first divider assembly 110*a* and the second divider assembly 110*b* and the central track 106, a third divider assembly (not shown) and a second central track (not shown) can be configured to connect to the front rail adjacent either the first divider assembly 110*a* or the second divider assembly 110*b*. Like the first divider assembly 110*a* and the second divider assembly 110*b*, the third divider assembly can also include a third divider wall separating the third divider assembly to define a pair of floors for receiving product, i.e., a fifth track and a sixth track for supporting product. Additionally like the central track 106, the second central track can be configured to extend between the respective divider assemblies. For example, the second central track can be configured to engage the second divider assembly, and the second central track can be configured to engage the third divider assembly to provide an additional row for product. Also the second central track can be provided with a pair of notches for engaging the second divider assembly and the third divider assembly for preventing the second divider assembly and the third divider assembly from splaying in relation to one another.

FIGS. 8-11*g* show another example merchandising display system 200, where like numerals indicate like elements as in the example shown in FIGS. 1-7. The example merchandise display system 200 is similar to the example disclosed above in relation to FIGS. 1-6. However, in this example, the central track 206 is provided with a spring tab 260 (shown in FIGS. 8 and 9) located on the underside of the central track 206.

Figure 9:
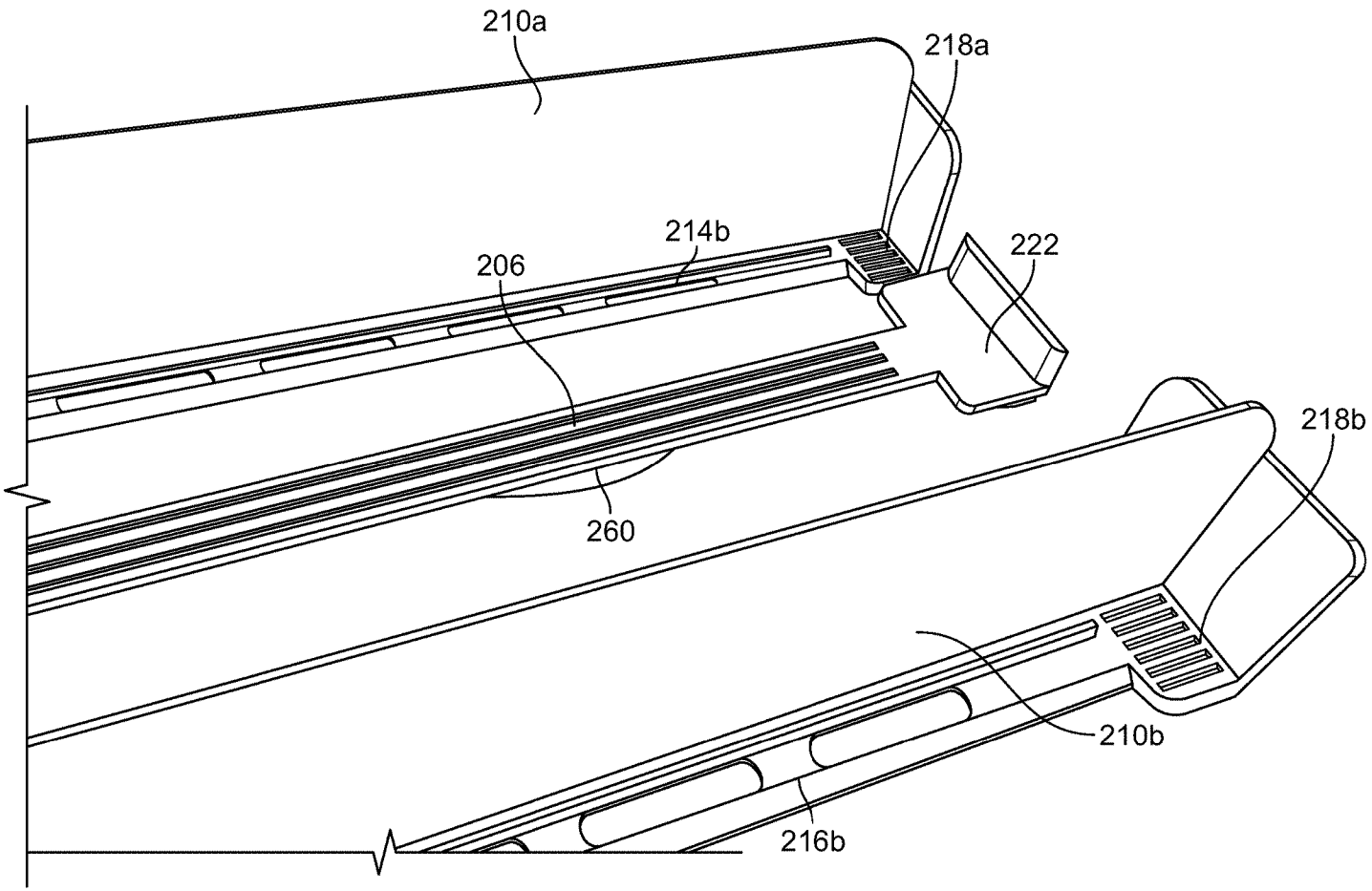
FIG. 9 shows a side perspective view of a rear portion of the example merchandise display system of FIG. 8.
Figure 10:
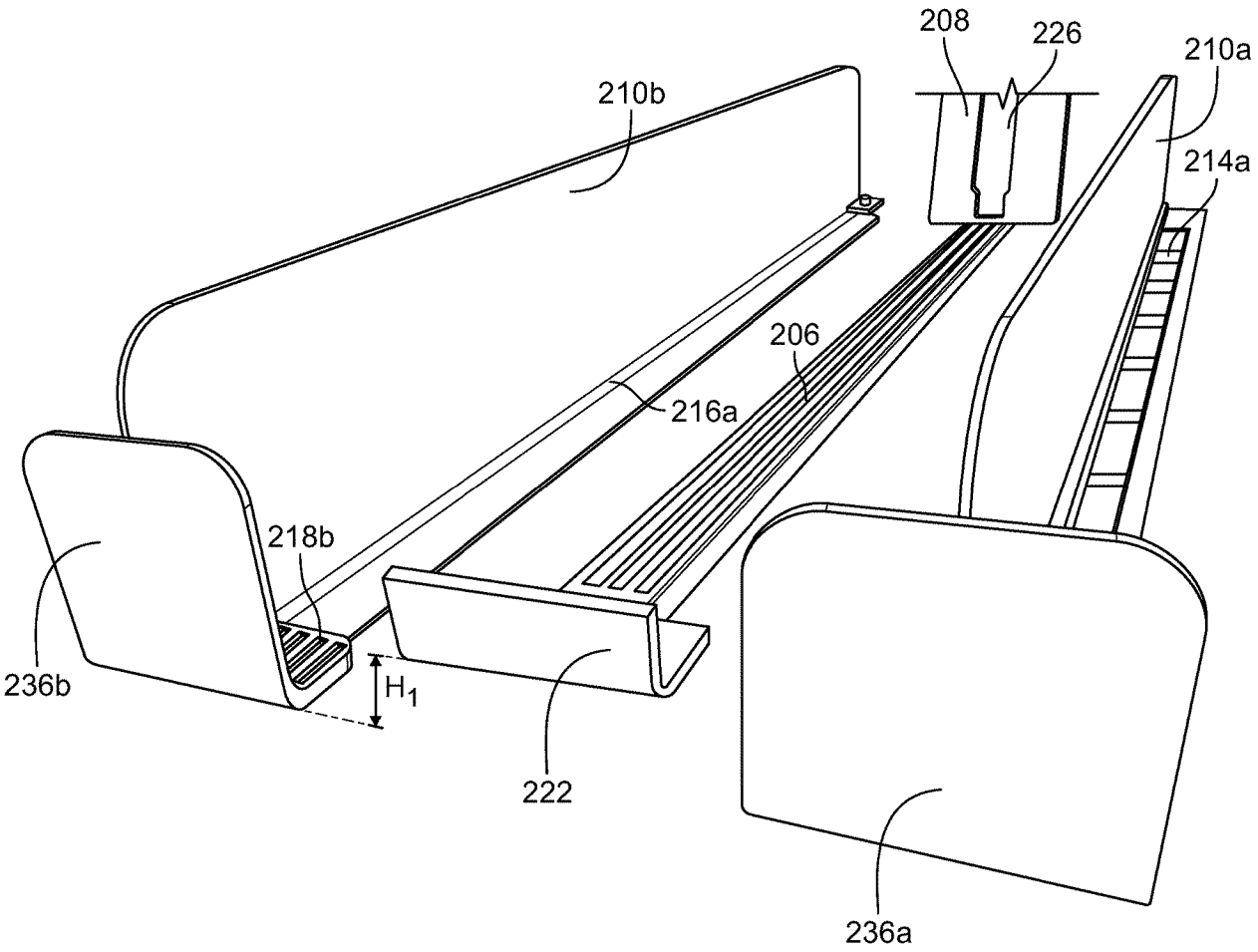
FIG. 10 shows a rear perspective view of the example merchandise display system of FIG. 8.

The spring tab 206 allows the user to freely adjust the first divider assembly 210*a* and the second divider assembly 210*b* before product is loaded in the merchandise display system 200. In particular, the spring tab 260 lifts the rear portion and flange 222 of the central track 206 to prevent the flange 222 of the central track 206 from engaging the rear portion of the first divider assembly 210*a* and the second divider assembly 210*b* when the merchandise display system 200 is in the unloaded condition. The spring tab 260 can be configured to engage the shelf floor and bias the central track 206 up off of the first divider assembly 210*a* and the second divider assembly 210*b* floors 214*a*, 214*b*, 216*a*, 216*b*, such that the first divider assembly 210*a* and the second divider assembly 210*b* can be moved relative to the central track 206. As shown in FIG. 9, the spring tab 260 can be configured to raise the central track 206 to a predetermined height $H_1$ above the floors 214*a*, 214*b*, 216*a*, 216*b* to allow for the first divider assembly 210*a* and the second divider assembly 210*b* to be freely adjusted relative to the central track 206. Once product is loaded into the merchandise display system 200, the weight of the product pushes down on the spring tab 260 and forces the spring downwardly into a recess (not shown) located at the bottom of the central track 206, such that the flange 222 engages the floors 214*b*, 216*a* of the divider assemblies 210*a*, 210*b* to help prevent the divider assemblies 210*a*, 210*b* from splaying.

In one example, the spring tab 206 can be a spring steel leaf spring. The spring tab 260, in one example, can be integrally molded into the central track 206 or can be attached to the central track 206 by any other fastening method. The spring tab 206 may also be formed of the same material as the central track in such a way that it resiliently extends from the bottom of the central track 206 when the merchandise display system 200 is in an unloaded position. For example, the spring tab 206 can be formed as a resilient lever or projection extending at a predetermined angle, and the bottom of the central track 206 may include a recess for receiving the lever or projection when the central track 206 is loaded with product. In other examples, the spring tab 260 can be an elastomeric material that resiliently deflects when the central track 206 is loaded with product.

Figure 11A:
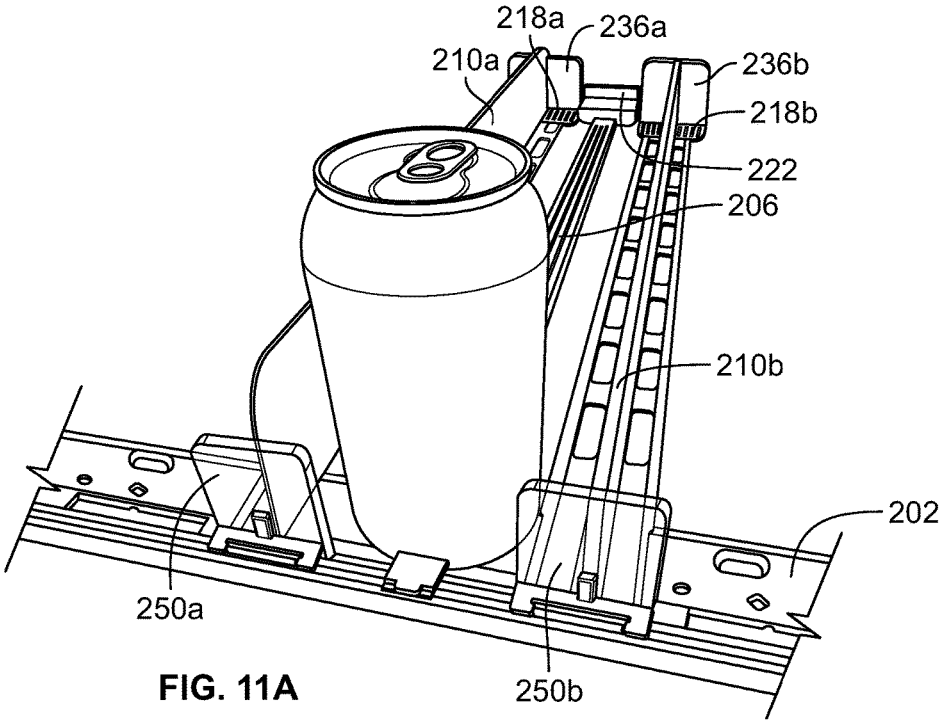
FIGS. 11*a*-11*g* depict an exemplary method of adjusting and loading the merchandise display system of FIG. 8.
Figure 11B:
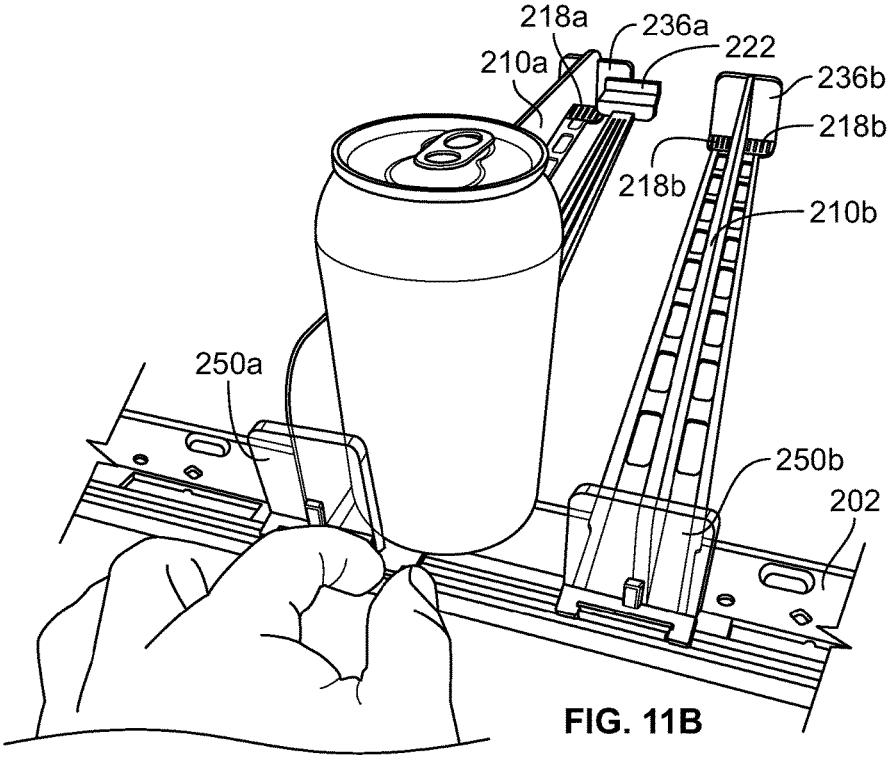
Figure 11C:
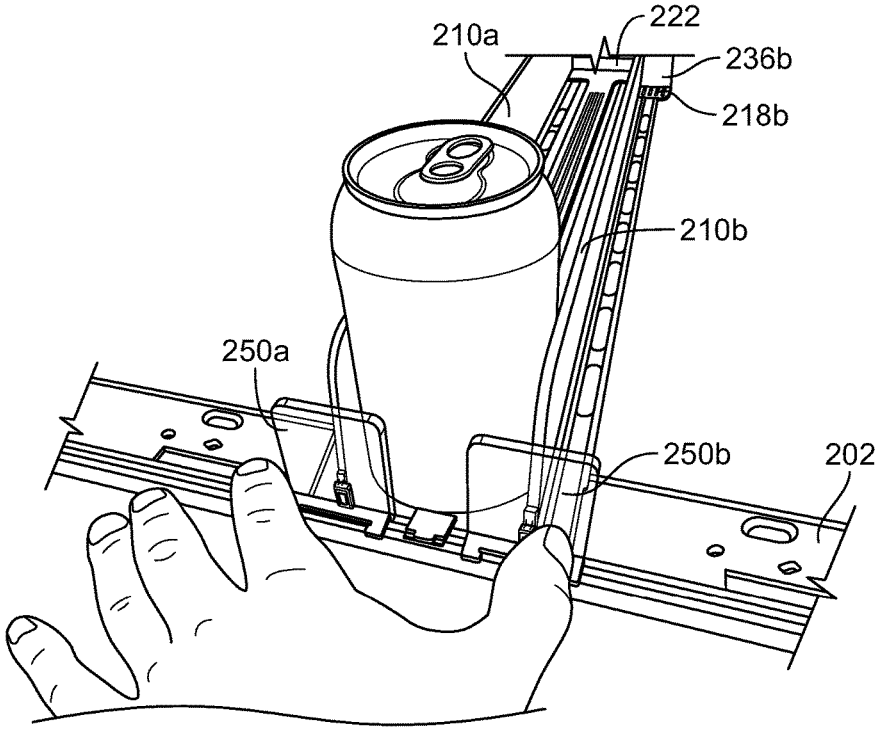
Figure 11D:
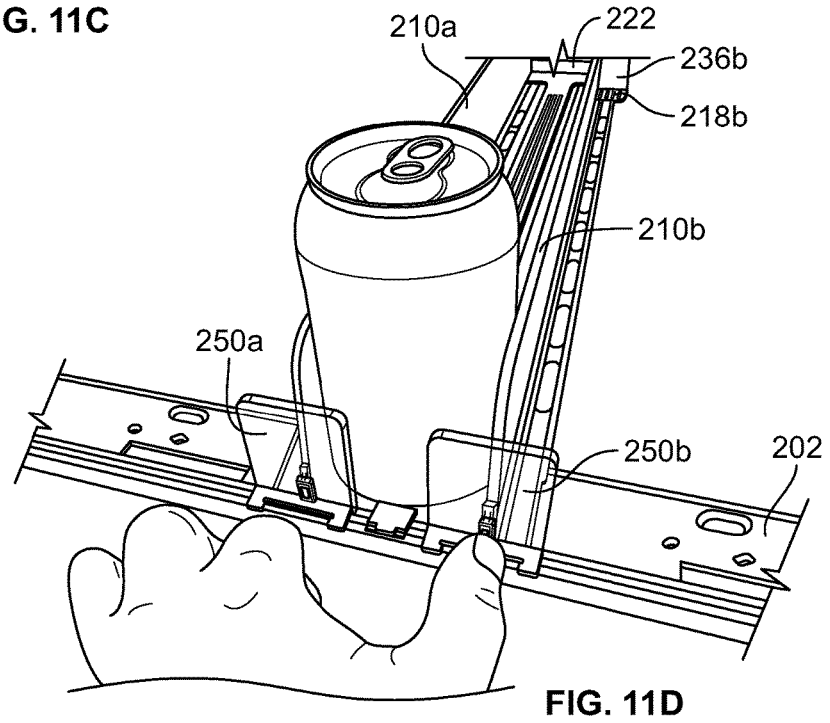
Figure 11E:
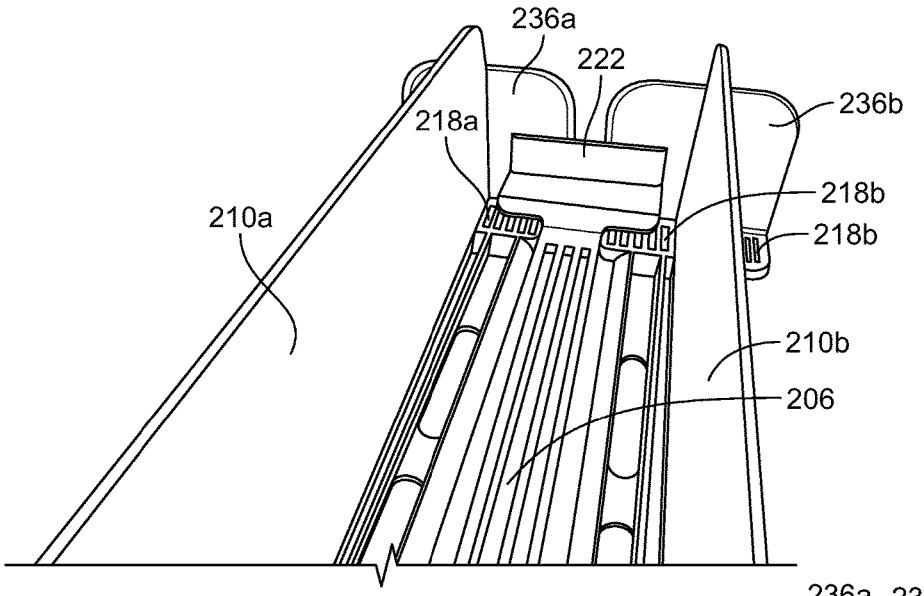
Figure 11F:
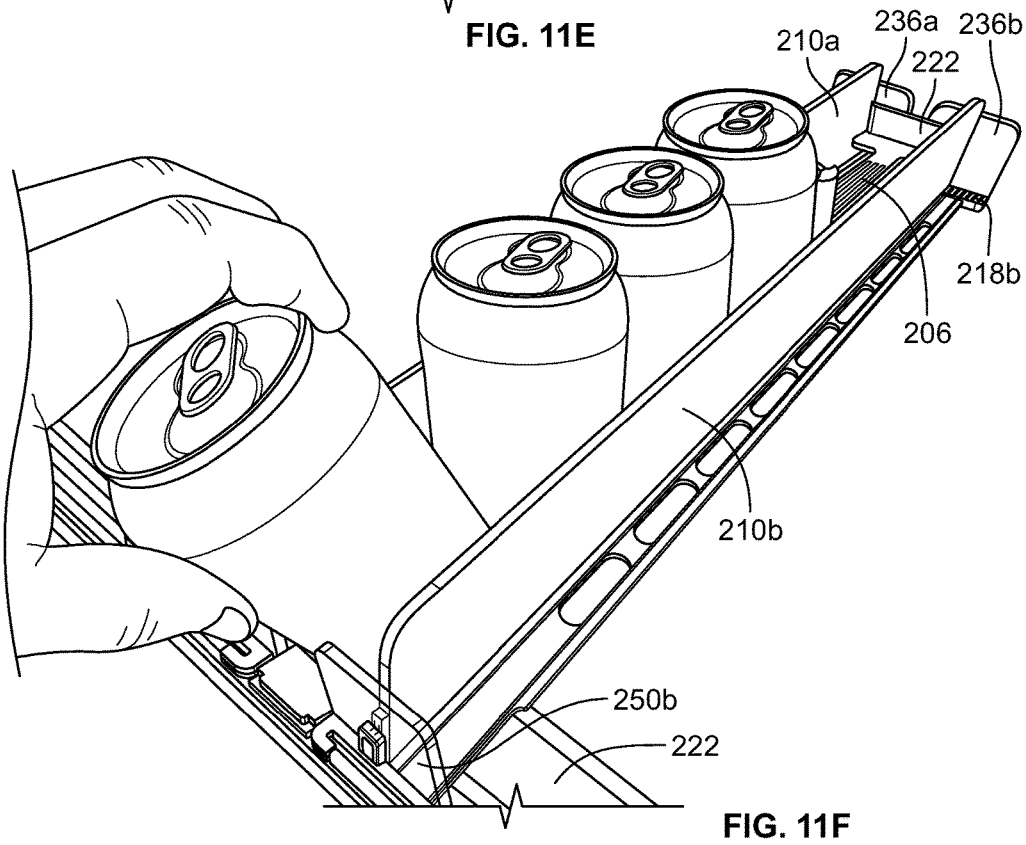
Figure 11G:
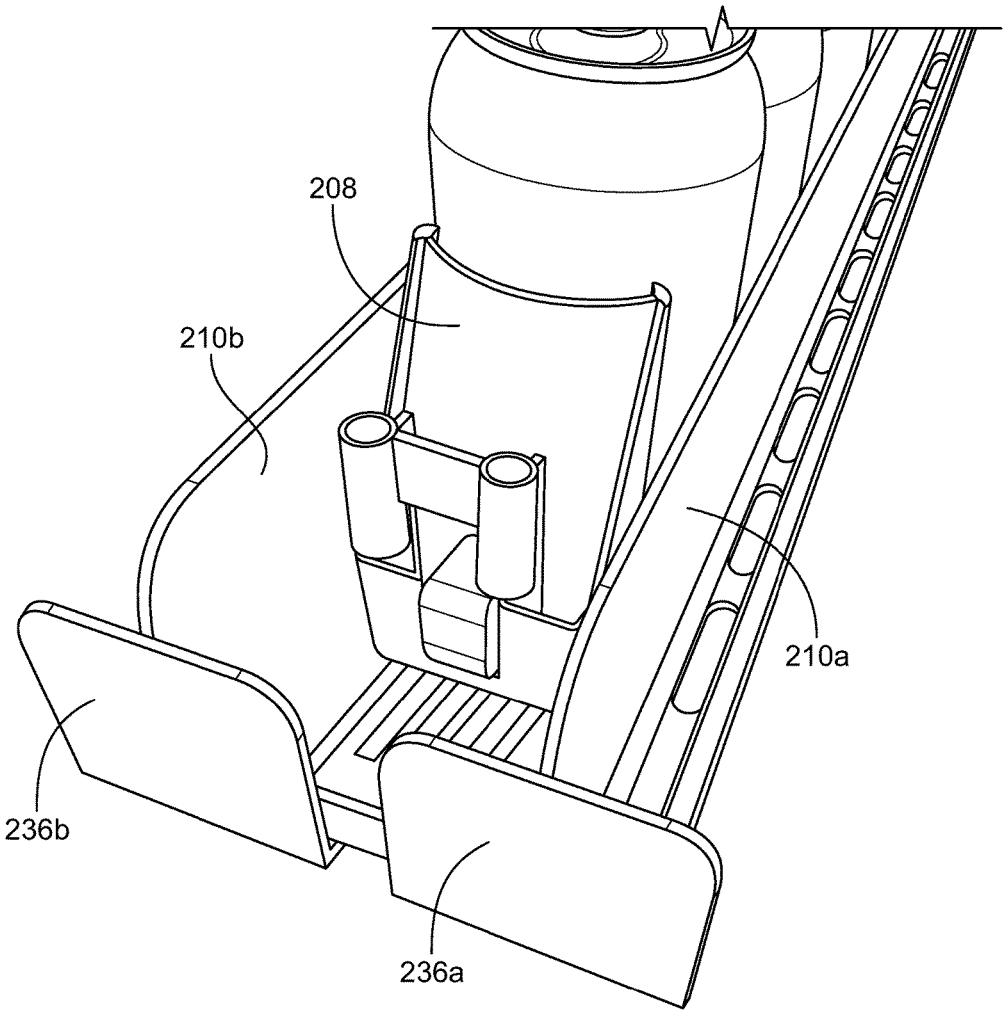

FIGS. 11*a*-11*g* show an exemplary method of adjusting and loading the merchandise display system 200. As shown in FIG. 11*a*, one row of product can be loaded in between the first divider assembly 210*a* and the second divider assembly 210*b*. In FIG. 11*b*, the central track 206 can be adjusted to the middle location of the product width. In FIG. 11*c*, with only one row of product loaded therein, the divider assemblies 210*a*, 210*b* can be moved freely underneath the rear portion of the central track 206, so that the product has just enough space to move forward in the merchandise display assembly 200. Next, the divider assemblies 210*a*, 210*b* can be locked into place on the front rail 202 in FIG. 11*d*. As shown in FIGS. 11*e*-11*g* as rows of product are added into the merchandise display assembly 200, the weight of the product flexes the spring tab 260 into the recess (not shown) on the bottom of the central track 206 and allows the flange 222 of the central track 206 to engage the divider assemblies 210*a*, 210*b*, which helps to secure the central track 206 and the divider assemblies 210*a*, 210*b* thereby helping to prevent splaying of the divider assemblies 210*a*, 210*b*.

Other alternative examples are contemplated for preventing splaying of the divider assemblies. For example, the flange can include slots or notches and the divider assemblies can include projections that can be received in the slots or notches in the flange. Moreover, other connection types are contemplated for connecting the divider assemblies to the central track, such as using texturized surfaces, interference fits, snap fits, ball and socket connections, threaded fasteners, hook and loop connections, elastomeric connections, adhesive connections, and the like. In addition, the flange and central track can be arranged such that the central track and flange sits below the divider assemblies. In this way when weight is placed on the divider assemblies, the divider assemblies will push down on the central track, which can help prevent the divider assemblies from splaying. Also, the flange can be located on other areas along the central track, and the divider assemblies can be provided with areas for receiving the flange, and the flange can be connected to the central track by any connection method. Moreover, a plurality of flanges can be provided on the central track. Each of the plurality of flanges can include pair of projections similar to flange 122 or can include a plurality of notches and the divider assemblies can include corresponding notches or projections for receiving the plurality of flanges. Also the flanges can include arms or upright sections for wrapping around the divider assemblies for preventing splaying. The arms or upright sections can be provided with an elastomeric material to accommodate for different sized product. In addition, the rear section of the divider assemblies can be provided with a cam lock and the rear of the shelf can be provided with a similar rail as the front rail 102 for locking the divider assemblies at their rear portions. Also the divider assemblies and shelves can be configured to removably connect at the rear portion of the divider assemblies. For example, the divider assemblies can be provided with projections that can be placed in corresponding recesses at the rear section of the shelf or can be provided with recesses for receiving corresponding projections on the shelf.

An example merchandise display system can include a front rail configured to mount to a shelf and a first divider assembly configured to connect to the front rail. The first divider assembly can include a first divider wall separating the first divider assembly to define a first track and a second track for supporting product, and the first divider assembly can define a first divider assembly front and a first divider assembly rear. The merchandise display system can also include a second divider assembly. The second divider assembly can be configured to connect to the front rail and can define a second divider assembly front and a second divider assembly rear. The second divider assembly can include a second divider wall separating the second divider assembly to define a third track and a forth track for supporting product.

The merchandise display system may also include a floor configured to connect to the front rail and can be configured to extend between the first divider wall and the second divider wall. The floor can be configured to engage the first divider assembly at the first divider assembly rear, and the floor can be configured to engage the second divider assembly at the second divider assembly rear to aid in preventing the first divider assembly and the second divider assembly from splaying in relation to one another. The floor can include a pusher assembly having a pusher paddle and a coiled spring positioned behind the pusher paddle and can be configured to bias the pusher paddle toward the front rail. The floor, the second track, and the third track can together form a surface for receiving at least one product.

In another example, the first divider assembly and the second divider assembly spacing can be adjustable. For example, each first divider section, e.g., the first track and the second track, can include a first plurality of notches, and each second divider section, e.g., the third track and the second track, can include a second plurality of notches. Also the floor can include a first projection and a second projection, and the first projection can be configured to extend into one of the first plurality of notches, and the second projection can be configured to extend into one of the second plurality of notches. The weight of the product causes the floor to engage the first divider assembly and the second divider assembly at the second divider assembly to aid in preventing the first divider assembly and the second divider assembly from splaying in relation to one another. The floor can also include a spring for raising the floor above a rear portion of the first divider assembly and a rear portion of the second divider assembly when the merchandise display system is in the unloaded position.

The merchandise display system may also include a third divider assembly. The third divider assembly can be configured to connect to the front rail and can include a third divider wall separating the third divider assembly to define a fifth track and a sixth track for supporting product. Also the merchandising assembly can include second floor, and the second floor can be configured to connect to the front rail and can be configured to extend between the second divider wall and the third divider wall. The second floor can also engage the second divider assembly and the third divider assembly to prevent the second divider assembly and the third divider assembly from splaying in relation to one another.

In another example, a method can include providing a front rail configured to connect to a shelf, providing a first divider assembly and configuring the first divider assembly to connect to the front rail. The first divider assembly can include a first divider wall and at least one first floor for supporting product. A second divider assembly can also be provided, and the method can also include configuring the second divider assembly to connect to the front rail. The second divider assembly can include a second divider wall and at least one second floor for supporting product. The method may include providing a track configured to connect to the front rail and configuring the track to extend between the first divider wall and the second divider wall. The method can also include configuring the track to engage the first divider assembly and configuring the track to engage the second divider assembly to help prevent the first divider assembly and the second divider assembly from splaying in relation to one another. The track, the at least one first floor, and the at least one second floor together form a surface for receiving at least one product.

The method can also include configuring the first divider assembly and the second divider assembly spacing to be adjustable. In addition, the method can include providing the at least one floor of the first divider assembly with a first plurality of notches, providing the at least one floor of the second divider assembly with a second plurality of notches, providing the track with a first projection and a second projection, and configuring the first projection to extend into one of the first plurality of notches and configuring the second projection to extend into one of the second plurality of notches. The method may also include providing the track with a pusher assembly having a pusher paddle and positioning a coiled spring behind the pusher paddle and configuring the coiled spring to bias the pusher paddle toward the front rail.

The method can also include providing a third divider assembly, configuring the third divider assembly to connect to the front rail, providing the third divider assembly with a third divider wall and at least one third floor for supporting product and providing a second track and configuring the second track to connect to the front rail and to extend between the second divider wall and the third divider wall. The second track can be configured to engage the second divider assembly, and the second floor can be configured to engage the third divider assembly to help prevent the second divider assembly and the third divider assembly from splaying in relation to one another.

The method may also include configuring the track to engage the first divider at a rear portion of the first divider assembly and configuring the track to engage the second divider assembly at a rear portion of the second divider assembly such that weight of product loaded on the at least one first floor, the at least one second floor, and the track aids in preventing the first divider assembly and the second divider assembly from splaying in relation to one another.

In another example, a merchandise display system can include a front rail configured to mount to a shelf and a first divider assembly configured to connect to the front rail. The first divider assembly can include a first divider assembly front and a first divider assembly rear. The first divider assembly can include a first divider wall separating the first divider assembly to define a first track and a second track for supporting product. The first track and the second track can include a first plurality of notches. The merchandise system may also include a second divider assembly defining a second divider assembly front and a second divider assembly rear. The second divider assembly can be configured to connect to the front rail, and the second divider assembly can include a second divider wall separating the second divider assembly to define a third track and a forth track for supporting product. The third track and the forth track can include a second plurality of notches.

A floor can be configured to connect to the front rail and can be configured to extend between the first divider wall and the second divider wall. The floor can include a first projection and a second projection. Additionally, the floor can engage the first divider assembly at the first divider assembly rear, and the floor can engage the second divider assembly at the second divider assembly rear such that the first projection extends into one of the first plurality of notches and the second projection extends into one of the second plurality of notches to aid in preventing the first divider assembly and the second divider assembly from splaying in relation to one another. The first plurality of notches, the second plurality of notches and the corresponding first and second projections allows for the first divider assembly and the second divider assembly spacing to be adjustable.

The floor can also include a pusher assembly having a pusher paddle and a coiled spring positioned behind the pusher paddle that is configured to bias the pusher paddle toward the front rail. The floor, the second track, and the third track can together form a surface for receiving at least one product.

The merchandise display system can also include a third divider assembly, and the third divider assembly can be configured to connect to the front rail. The third divider assembly can include a third divider wall separating the third divider assembly to define a fifth track and a sixth track for supporting product. The merchandise display system can also include a second floor, and the second floor can be configured to connect to the front rail and can be configured to extend between the second divider wall and the third divider wall. Also the second floor can be configured to engage the second divider assembly and the third divider assembly to help prevent the second divider assembly and the third divider assembly from splaying in relation to one another. Additionally the weight of the product can cause the floor to forcefully engage the first divider assembly and the second divider assembly at the second divider assembly to aid in preventing the first divider assembly and the second divider assembly from splaying in relation to one another.

Variations and modifications of the foregoing are within the scope of the present disclosure. For example, one of skill in the art will understand that multiples of the described components may be used in stores and in various configurations. The present disclosure is therefore not to be limited to a single system, nor the upright pusher configuration, depicted in the Figures, as the system is simply illustrative of the features, teachings and principles of the disclosure. It should further be understood that the disclosure defined herein extends to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure.

What is claimed is:

1. A merchandise display system comprising:

a front rail configured to mount to a shelf;

a first divider assembly configured to connect to the front rail, the first divider assembly defining a first divider assembly front and a first divider assembly rear the first divider assembly comprising a first divider wall separating the first divider assembly to define a first track and a second track for supporting product;

a second divider assembly defining a second divider assembly front and a second divider assembly rear, the second divider assembly configured to connect to the front rail, the second divider assembly comprising a second divider wall separating the second divider assembly to define a third track and a fourth track for supporting product; and a floor configured to connect to the front rail and configured to extend between the first divider wall and the second divider wall;

wherein the floor engages the first divider assembly at the first divider assembly rear and the floor engages the second divider assembly at the second divider assembly rear to aid in preventing the first divider assembly and the second divider assembly from splaying in relation to one another;

wherein the floor further comprises a spring for raising the floor above a rear portion of the first divider assembly and a rear portion of the second divider assembly when the merchandise display system is in an unloaded position.

2. The merchandise display system of claim 1 wherein the first divider assembly and the second divider assembly spacing is adjustable.

3. The merchandise display system of claim 2 wherein the first track and the second track comprises a first plurality of notches, and wherein the third track and the fourth track comprises a second plurality of notches, the floor comprising a first projection and a second projection, the first projection configured to extend into one of the first plurality of notches and the second projection configured to extend into one of the second plurality of notches.

4. The merchandise display system of claim 1 wherein the floor further comprises a pusher assembly having a pusher paddle and a coiled spring positioned behind the pusher paddle and configured to bias the pusher paddle toward the front rail.

5. The merchandise display system of claim 1 wherein the floor, the second track, and the third track together form a surface for receiving at least one product.

6. The merchandise display system of claim 1 further comprising a third divider assembly, the third divider assembly configured to connect to the front rail, the third divider assembly comprising a third divider wall separating the third divider assembly to define a fifth track and a sixth track for supporting product and a second floor and wherein the second floor is configured to connect to the front rail and is configured to extend between the second divider wall and the third divider wall; wherein the second floor engages the second divider assembly and the second floor engages the third divider assembly to prevent the second divider assembly and the third divider assembly from splaying in relation to one another.

7. The merchandise display system of claim 1 wherein weight of the product causes the floor to engage the first divider assembly and the second divider assembly to aid in preventing the first divider assembly and the second divider assembly from splaying in relation to one another.

8. A method comprising:

providing a front rail configured to connect to a shelf;

providing a first divider assembly and configuring the first divider assembly to connect to the front rail, the first divider assembly comprising a first divider wall and at least one first floor for supporting product;

providing a second divider assembly, configuring the second divider assembly to connect to the front rail, the second divider assembly comprising a second divider wall and at least one second floor for supporting product;

providing a track and configuring the track to connect to the front rail and configuring the track to extend between the first divider wall and the second divider wall, and configuring the track to engage the first divider assembly and configuring the track to engage the second divider assembly to help prevent the first divider assembly and the second divider assembly from splaying in relation to one another; and providing the track with a spring for raising the track above a rear portion of the first divider assembly and a rear portion of the second divider assembly the track is in an unloaded position.

9. The method of claim 8 further comprising configuring the first divider assembly and the second divider assembly spacing to be adjustable.

10. The method of claim 9 further comprising providing the at least one floor of the first divider assembly with a first plurality of notches, providing the at least one floor of the second divider assembly with a second plurality of notches, providing the track with a first projection and a second projection, where the first projection is configured to extend into one of the first plurality of notches and the second projection is configured to extend into one of the second plurality of notches.

11. The method of claim 8 further comprising providing the track with a pusher assembly having a pusher paddle and positioning a coiled spring behind the pusher paddle and configuring the coiled spring to bias the pusher paddle toward the front rail.

12. The method of claim 8 wherein the track, the at least one first floor, the at least one second floor together form a surface for receiving at least one product.

13. The method of claim 8 further comprising providing a third divider assembly, configuring the third divider assembly to connect to the front rail, providing the third divider assembly with a third divider wall and at least one third floor for supporting product and a second track and configuring the second track to connect to the front rail and to extend between the second divider wall and the third divider wall; wherein the second track engages the second divider assembly and the second floor engages the third divider assembly to help prevent the second divider assembly and the third divider assembly from splaying in relation to one another.

14. The method of claim 8 further comprising configuring the track to engage the first divider assembly at a rear portion of the first divider assembly and configuring the track to engage the second divider assembly at a rear portion of the second divider assembly such that weight of product loaded on the at least one first floor, the at least one second floor, and the track aids in preventing the first divider assembly and the second divider assembly from splaying in relation to one another.

15. A merchandise display system comprising:

a front rail configured to mount to a shelf;

a first divider assembly configured to connect to the front rail, the first divider assembly comprising a first divider assembly front and a first divider assembly rear the first divider assembly comprising a first divider wall separating the first divider assembly to define a first track and a second track for supporting product, the first track and the second track comprising a first plurality of notches;

a second divider assembly defining a second divider assembly front and a second divider assembly rear, the second divider assembly configured to connect to the front rail, the second divider assembly comprising a second divider wall separating the second divider assembly to define a third track and a forth track for supporting product, the third track and the forth track comprising a second plurality of notches; and a floor configured to connect to the front rail and configured to extend between the first divider wall and the second divider wall, the floor having a first projection and a second projection;

wherein the floor engages the first divider assembly at the first divider assembly rear and the floor engages the second divider assembly at the second divider assembly rear such that the first projection extends into one of the first plurality of notches and the second projection extends into one of the second plurality of notches to aid in preventing the first divider assembly and the second divider assembly from splaying in relation to one another;

wherein weight of a product causes the floor to engage the first divider assembly and the second divider assembly to aid in preventing the first divider assembly and the second divider assembly from splaying in relation to one another;

wherein a spring causes the floor to disengage the first divider assembly and the second divider assembly when the weight of the product is removed.

16. The merchandise display system of claim 15 wherein the first divider assembly and the second divider assembly spacing is adjustable.

17. The merchandise display system of claim 15 wherein the floor further comprises a pusher assembly having a pusher paddle and a coiled spring positioned behind the pusher paddle and configured to bias the pusher paddle toward the front rail.

18. The merchandise display system of claim 15 wherein the floor, the second track, and the third track together form a surface for receiving at least one product.

19. The merchandise display system of claim 15 further comprising a third divider assembly, the third divider assembly configured to connect to the front rail, the third divider assembly comprising a third divider wall separating the third divider assembly to define a fifth track and a sixth track for supporting product and a second floor and wherein the second floor is configured to connect to the front rail and is configured to extend between the second divider wall and the third divider wall, wherein the second floor engages the second divider assembly and the second floor engages the third divider assembly to help prevent the second divider assembly and the third divider assembly from splaying in relation to one another.

* * * * *